US010262569B2

(12) United States Patent
Watanabe et al.

(10) Patent No.: US 10,262,569 B2
(45) **Date of Patent: *Apr. 16, 2019**

(54) CONTROL DEVICE, DISPLAY DEVICE CONFIGURED TO ADJUST THE GRAYSCALE OF A DISPLAYED IMAGE IN WHICH FLICKER IS EASILY RECOGNIZABLE, AND METHOD FOR CONTROLLING DISPLAY DEVICE

(71) Applicant: Sharp Kabushiki Kaisha, Osaka-shi, Osaka (JP)

(72) Inventors: Tatsuo Watanabe, Osaka (JP); Kenji Maeda, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 86 days.

This patent is subject to a terminal disclaimer.

(21) Appl. No.: 14/784,657

(22) PCT Filed: Mar. 28, 2014

(86) PCT No.: PCT/JP2014/059154

§ 371 (c)(1),
(2) Date: Oct. 15, 2015

(87) PCT Pub. No.: WO2014/171299

PCT Pub. Date: Oct. 23, 2014

(65) Prior Publication Data

US 2016/0078798 A1 Mar. 17, 2016

(30) Foreign Application Priority Data

Apr. 18, 2013 (JP) ..... 2013-087809

(51) Int. Cl.
*G09G 5/10* (2006.01)
*G09G 3/20* (2006.01)
(Continued)

(52) U.S. Cl.
CPC ..... *G09G 3/2007* (2013.01); *G09G 3/3413* (2013.01); *G09G 3/3648* (2013.01);
(Continued)

(58) Field of Classification Search
None
See application file for complete search history.

(56) References Cited

U.S. PATENT DOCUMENTS

2002/0080127 A1* 6/2002 Park ..... G09G 3/3406 345/204
2004/0135799 A1* 7/2004 Shiomi ..... G09G 3/3648 345/690

(Continued)

FOREIGN PATENT DOCUMENTS

JP 11-272236 A 10/1999
JP 11272236 A * 10/1999 ..... G09G 3/2018

(Continued)

OTHER PUBLICATIONS

Official Communication issued in International Patent Application No. PCT/JP2014/059154, dated Jul. 1, 2014.

*Primary Examiner* — Abdul-Samad A Adediran
*Assistant Examiner* — Kirk W Hermann
(74) *Attorney, Agent, or Firm* — Keating & Bennett, LLP

(57) ABSTRACT

In order to attain an object to provide a display device capable of suppressing electric power consumption as well as displaying an image with excellent quality, a control device includes a control information output section (36) for, in a case where an image determining section (35) determines that an image is a flickering image, supplying, to a grayscale level control section (80), grayscale level control information for causing the grayscale level control section to carry out control for increasing or lowering a grayscale level of a pixel in which flicker is easily recognizable.

14 Claims, 12 Drawing Sheets

(51) Int. Cl.
*G09G 3/34* (2006.01)
*G09G 3/36* (2006.01)

(52) U.S. Cl.
CPC ..... *G09G 3/3406* (2013.01); *G09G 2310/027* (2013.01); *G09G 2320/0233* (2013.01); *G09G 2320/0247* (2013.01); *G09G 2320/0252* (2013.01); *G09G 2320/0271* (2013.01); *G09G 2320/0626* (2013.01); *G09G 2340/0435* (2013.01); *G09G 2360/144* (2013.01)

(56) References Cited

U.S. PATENT DOCUMENTS

| | | | | |
|---|---|---|---|---|
| 2009/0122207 | A1 | 5/2009 | Inoue et al. | |
| 2009/0251445 | A1* | 10/2009 | Ito ..... | G09G 3/3648 345/204 |
| 2011/0187754 | A1* | 8/2011 | Yoo ..... | G09G 5/10 345/690 |
| 2012/0169785 | A1* | 7/2012 | Kawabe ..... | G09G 3/2022 345/690 |

FOREIGN PATENT DOCUMENTS

| | | | | |
|---|---|---|---|---|
| JP | 11272236 | A * | 10/1999 | ..... G09G 3/2018 |
| JP | 2002-215120 | A | 7/2002 | |
| JP | 2006-208854 | A | 8/2006 | |
| JP | 2008-107653 | A | 5/2008 | |
| JP | 2009-251607 | A | 10/2009 | |
| WO | 2006/100988 | A1 | 9/2006 | |

* cited by examiner (a)

(b)

| FLICKER \ ENVIRONMENT | (1) DARKROOM (0 lx) + MAXIMUM BRIGHTNESS (400cd/m²) | (2) INDOORS (600 lx) + AUTOMATICALLY-CONTROLLED BRIGHTNESS (140cd/m²) | (3) OUTDOORS (2000 lx) + MAXIMUM BRIGHTNESS (400cd/m²) |
|---|---|---|---|
| RECOGNIZABLE | 20-80 | 24-76 | NOT RECOGNIZABLE |
| ANNOYING | 24-76 | 28-68 | NOT RECOGNIZABLE |

CONTROL DEVICE, DISPLAY DEVICE CONFIGURED TO ADJUST THE GRAYSCALE OF A DISPLAYED IMAGE IN WHICH FLICKER IS EASILY RECOGNIZABLE, AND METHOD FOR CONTROLLING DISPLAY DEVICE

TECHNICAL FIELD

The present invention relates to a control device, a display device, and a method for controlling the display device.

BACKGROUND ART

In recent years, thin, light, and low-power-consumption display devices such as liquid crystal display devices have been remarkably widespread. Typical examples of apparatuses on which to mount such display devices encompass mobile phones, smartphones, notebook-sized PCs (Personal Computers). It is expected that in the future, development and prevalence of electronic paper, which is an even thinner display device, will be rapidly advanced. Under such circumstances, it is a common challenge to reduce power consumption of display devices.

According to conventional CG (Continuous Grain) silicon TFT liquid crystal display panels, amorphous silicon TFT liquid crystal display panels, and the like, it is necessary to refresh a screen at 60 Hz. Therefore, for a reduction in electronic power consumption of the conventional liquid crystal display panels, attempts have been made to achieve a refresh rate lower than 60 Hz.

Patent Literature 1 discloses a liquid crystal display configured such that in a case where no stripes are present in an image over a series of frames, the liquid crystal display device (i) determines that the frames have no characteristic that easily induces flicker and then (ii) lowers a refresh rate.

CITATION LIST

Patent Literature

[Patent Literature 1]
Japanese Patent Application Publication Tokukai No. 2009-251607 (Publication date: Oct. 29, 2009)

SUMMARY OF INVENTION

Technical Problem

However, with liquid crystal display panels employing CG silicon TFTs or amorphous silicon TFTs, it is only possible to lower a refresh rate to 50 Hz at best while maintaining display quality.

In recent years, diligent attempts have been made to develop an oxide semiconductor liquid crystal display panel in which TFTs are each constituted by an oxide semiconductor that uses indium (In), gallium (Ga), and zinc (Zn). According to a TFT constituted by an oxide semiconductor, only a small amount of electric current leaks in an off state. Therefore, unlike the cases of conventional liquid crystal panels, it is unnecessary for an oxide semiconductor liquid crystal display panel to refresh a screen at 60 Hz, and it is therefore possible to lower a refresh rate to approximately 1 Hz. This allows for a reduction in electric power consumption.

In a case where high-speed image rewriting occurs as in, for example, scrolling, an oxide semiconductor liquid crystal display panel is subjected to driving at a high frequency (hereinafter referred to as "high refresh driving") in accordance with such image rewriting. Meanwhile, in a case where no image rewriting occurs as in a still image, the oxide semiconductor liquid crystal display panel is subjected to driving at a low frequency (hereinafter referred to as "low refresh driving").

However, in a case where response speed of liquid crystals is slow, driving a display device at a low refresh rate poses a problem of causing flicker to be easily recognized and consequently causing lower display quality due to non-uniform pixel capacitances (variation in capacitance) or the like. Since slow response speed of liquid crystals causes an alignment status of liquid crystals to change over a period in which a screen is not refreshed, changes in grayscale levels can be easily recognized. In addition, electric charge leaks from pixels via TFTs in an off state. Therefore, in a case where pixel capacitance is not uniform, a change in pixel potential differs from pixel to pixel.

However, in a case where high refresh driving is carried out so that such problems as described above are solved, it is impossible to achieve lower electric power consumption. This makes it impossible to utilize an advantage of an oxide semiconductor liquid crystal display panel.

The present invention has been made in view of the problems, and an object of the present invention is to realize a display device capable of suppressing electric power consumption as well as displaying an image with excellent quality.

Solution to Problem

A control device in accordance with an aspect of the present invention is a control device for a display device, the control device including: an image determining section for determining whether or not an image is a flickering image which has a characteristic of causing flicker to be easily recognizable; and a control information output section for, in a case where the image determining section determines that the image is the flickering image, supplying, to a grayscale level control section for carrying out control for changing a grayscale level of the flickering image, grayscale level control information for causing the grayscale level control section to carry out control for increasing or lowering a grayscale level of at least one pixel in which the flicker is easily recognizable.

A control method in accordance with an aspect of the present invention is a method for controlling a display device, the method including the steps of: a) determining whether or not an image is a flickering image which has a characteristic of causing flicker to be easily recognizable; and b) in a case where it is determined in the step a) that the image is the flickering image, supplying, to a grayscale level control section for carrying out control for changing a grayscale level of the flickering image, grayscale level control information for causing the grayscale level control section to carry out control for increasing or lowering a grayscale level of a pixel in which the flicker is easily recognizable.

Advantageous Effects of Invention

An aspect of the present invention yields an effect of displaying an image with excellent quality.

Additional objects, features, and strengths of the present invention will be made clear by the description below.

Further, the advantages of the present invention will be evident from the following explanation in reference to the drawings.

DESCRIPTION OF EMBODIMENTS

Figure 1:
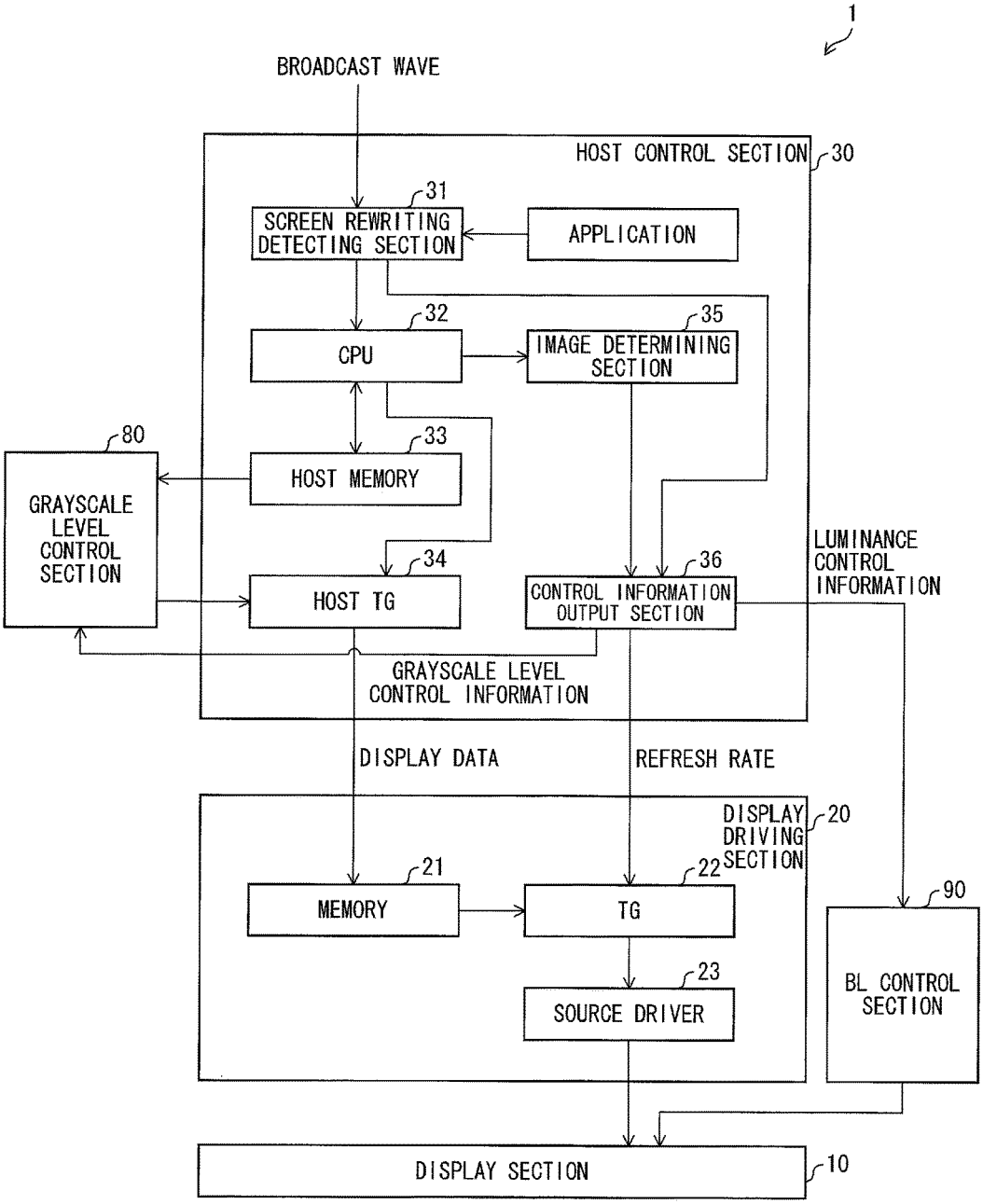
FIG. 1 is a block diagram illustrating a configuration of a display device in accordance with an aspect of the present invention.

An embodiment of the present invention is described below with reference to FIG. 1 to FIG. 13. A description of a configuration other than those described in the specific embodiments below may be appropriately omitted. Note, however, that, in a case where such a configuration is described in another embodiment, the configuration is identical to that described in the another embodiment. Note also that, for convenience, members having functions identical to those of the respective members described in the embodiments are given respective identical reference numerals, and a description of those members is appropriately omitted.

Embodiment 1

Figure 2:
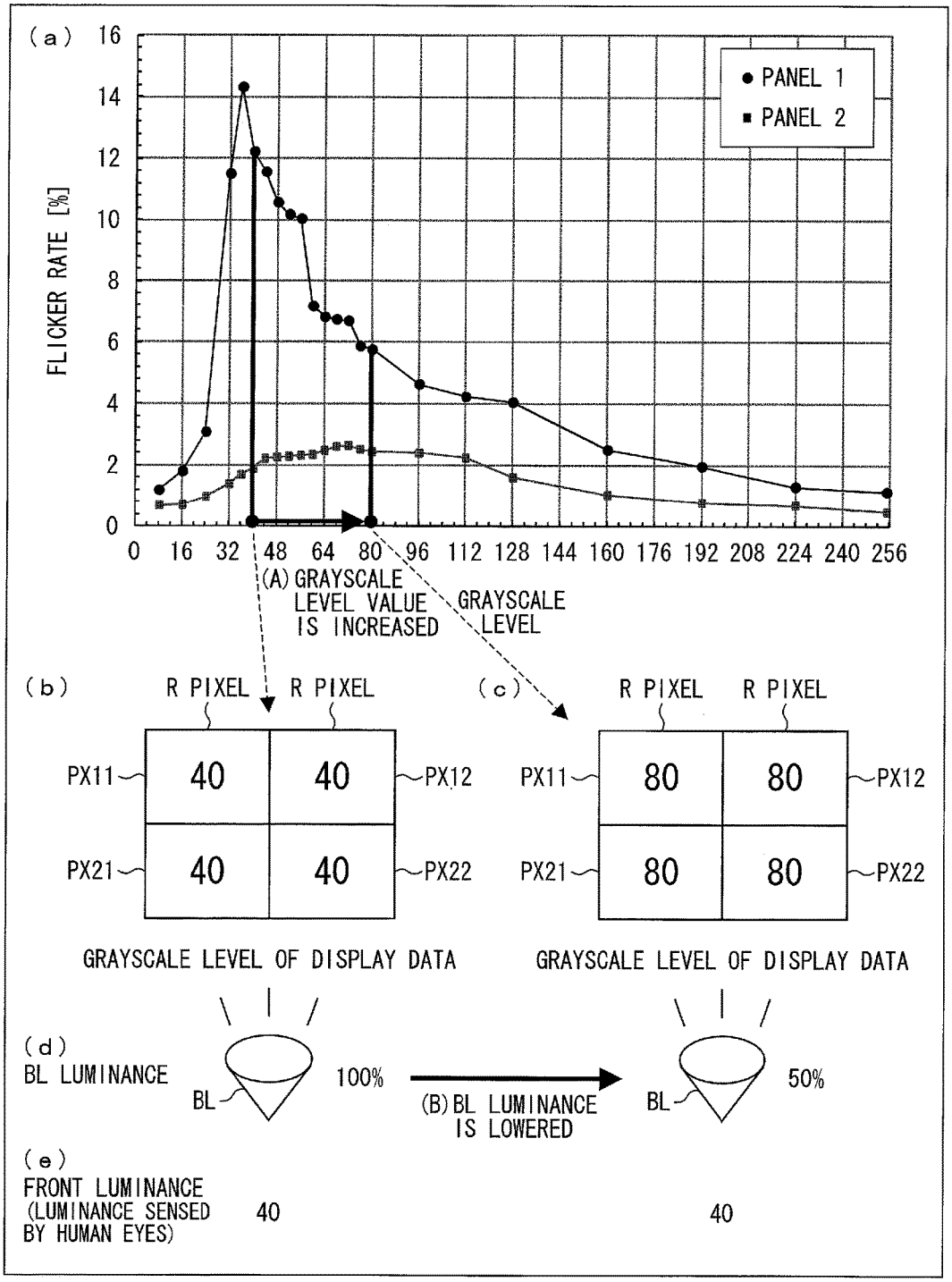
FIG. 2 is a set of views for explaining a method for controlling the display device. (a) of FIG. 2 is a graph showing flicker rates corresponding to respective grayscale levels at which an oxide semiconductor liquid crystal display panel is driven with a refresh rate of 1 Hz. (b) and (c) of FIG. 2 show a state in which grayscale level values of pixels have been increased. (d) of FIG. 2 shows a state in which a backlight luminance has been lowered. (e) of FIG. 2 shows a state of a front luminance of a pixel which has not been subjected to a change in grayscale level and lowering of the luminance and a state of the front luminance of the pixel which has been subjected to the change in grayscale level and lowering of the luminance.

(a) of FIG. 2 is a graph showing flicker rates corresponding to respective grayscale levels at which an oxide semiconductor liquid crystal display panel is driven with a refresh rate of 1 Hz. (b) and (c) of FIG. 2 show a state in which grayscale level values of pixels have been increased. (d) of FIG. 2 shows a state in which a backlight luminance has been lowered. (e) of FIG. 2 shows a state of a front luminance of a pixel which has not been subjected to a change in grayscale level and lowering of the luminance and a state of the front luminance of the pixel which has been subjected to the change in grayscale level and lowering of the luminance. A flicker rate shown in (a) of FIG. 2 indicates a degree to which flicker is recognizable, and a larger value of the flicker rate means greater recognizability of the flicker. A flicker rate of 1.5%, for example, is one indicator of whether or not flicker can be easily recognized. In a case where the oxide semiconductor liquid crystal display panel is driven at a low refresh rate, it is a grayscale level of an image that determines whether or not flicker easily occurs. In FIG. 2, a minimum grayscale level (black) is 0, whereas a maximum grayscale level (white) is 255. Note that recognizability of flicker also varies, depending on a screen size and production process. A panel 1 is a liquid crystal display panel greater in size than a panel 2. The panel 1 and the panel 2 also differ in production process.

A response speed of liquid crystals at intermediate grayscale levels is relatively slow. In addition, at the intermediate grayscale levels, a change in grayscale level (change in alignment of liquid crystal molecules) as a result of leakage of electric charge via TFTs can easily occur. Note that "intermediate grayscale levels" refer to all grayscale levels except for saturated grayscale levels (i.e. the maximum grayscale level and the minimum grayscale level). For example, where the minimum grayscale level and the maximum grayscale level are 0 and 255, respectively, grayscale levels falling within a range of grayscale level 1 to grayscale level 254 are intermediate grayscale levels. In a case of a normally-black type, flicker is more easily recognizable in a range of, for example, grayscale level 10 to grayscale level 200 of all the intermediate grayscale levels. Furthermore, flicker is even more easily recognizable in a range of grayscale level 20 to grayscale level 80, and is particularly easily recognizable in a range of grayscale level 40 to grayscale level 60. For example, in a case where an image including a large number of pixels having grayscale levels of the above described ranges is displayed at a refresh rate of 1 Hz, a screen is refreshed every second. This may cause a user to recognize flicker every second.

As illustrated in FIG. 2, flicker tends to be remarkably easily recognizable on the lower grayscale level side especially at an intermediate grayscale level equal to or higher than grayscale level 10. In view of this, according to Embodiment 1, a grayscale level of an image that includes a large number of pixels having grayscale levels falling within a predetermined range (within a range of flickering grayscale levels that are set in advance as grayscale levels which fall within a range of intermediate grayscale levels and at each of which flicker easily occurs) (hereinafter such an image is referred to as a "flickering image") is increased. This prevents recognizability of flicker due to an image that includes a large number of pixels having grayscale levels falling within a flickering grayscale range.

A flickering grayscale level is constant regardless of a luminance of a backlight (hereinafter abbreviated as "BL"). Note, however, that flicker tends to be hardly recognizable to human eyes in a case where a BL luminance is low. In view of this, according to Embodiment 1, the BL luminance is lowered in a case where an image is a flickering image. This prevents recognizability of flicker due to a high BL luminance.

Further, as described earlier, the grayscale level is increased and the BL luminance is lowered, so that each pixel is prevented from changing in front luminance before and after a change in grayscale level and BL luminance. Thus, a change in display quality is also prevented.

For example, (b) of FIG. 2 shows a grayscale level of image data which grayscale level has not been changed, and (c) of FIG. 2 shows the grayscale level of the image data which grayscale level has been changed. (b) of FIG. 2 and (c) of FIG. 2 each focus on only R pixels. In the image data whose grayscale level has not been changed, assume that R pixels in a target region have a grayscale level of 40. In this case, when grayscale level 40 falls within the flickering grayscale range and an image determining section 35 determines that the image data is a flickering image, a control information output section 36 transmits grayscale level control information to a grayscale level control section 80, and the grayscale level control section which has received the grayscale level control information changes a grayscale level value to 80 at a two-fold changing magnification (see, for example, (b) of FIG. 2) (A). Note that, for easiness of understanding, it is herein assumed that a grayscale level and a transmittance of a pixel are in proportion to each other. Unless the grayscale level and the transmittance of the pixel are in proportion to each other, the grayscale level and the BL luminance are changed so that a product of the transmittance and the BL luminance is not changed (i.e., so that a luminance of the pixel is not changed). Configurations of, for example, the image determining section, the control information output section, and the grayscale level control section are described later.

(d) of FIG. 2, for example shows the BL luminance obtained before lowering of the luminance (a maximum luminance value is assumed as 100%) and the BL luminance obtained after a change in the luminance (50%). It is assumed that the BL luminance obtained before the lowering of the luminance has the maximum luminance value (100%).

In this case, the control information output section 36 transmits luminance control information to a BL control section 90. For example, the BL control section 90 which has received the luminance level control information changes the BL luminance to 50% with a two-fold lowering magnification (B).

Note here that a grayscale level changing magnification is obtained by dividing a grayscale level of a pixel in image data which has been changed by the grayscale level of the pixel in the image data which has not been changed. Meanwhile, a BL luminance changing magnification is obtained by dividing a frequency of a current PWM signal by a maximum frequency of a PMW signal.

According to the above examples, (A) an amount of change in grayscale level and (B) an amount of change in BL luminance are each set so as not to change respective front luminances (luminances sensed by human eyes) of a plurality of pixels in an image.

(Configuration of Display Device 1)

FIG. 1 is a block diagram illustrating a configuration of a display device in accordance with an embodiment of the present invention. A display device 1 includes a display section 10, a display driving section 20, a host control section 30 (control device), the grayscale level control section 80, and the BL control section (backlight control section) 90.

The display section 10 includes, for example, (i) a screen constituted by an oxide semiconductor liquid crystal display panel serving as an active matrix liquid crystal display panel, and (ii) a BL. The oxide semiconductor liquid crystal display panel is a liquid crystal display panel in which the above-described oxide semiconductor-TFT is used as each switching element provided so as to correspond to one or more of a plurality of pixels that are two dimensionally arranged. The oxide semiconductor-TFT is a TFT having a semiconductor layer made of an oxide semiconductor. Examples of the oxide semiconductor encompass an oxide semiconductor (In—Ga—Zn—O) in which an oxide of indium, gallium, and zinc is used. According to the oxide semiconductor-TFT, (i) an amount of electric current flowing in an on state is large and (ii) an amount of leak current in an off state is small. Therefore, by using the oxide semiconductor-TFT for a switching element, it is possible to increase a pixel aperture ratio and to reduce a refresh rate of image display to approximately 1 Hz. Reducing the refresh rate allows for such an effect as a reduction in electric power consumption. An increase in a pixel aperture ratio brings about such an effect as causing a displayed image to be brighter. In a case where the brightness of image display is to be set equal to that of a CG silicon liquid crystal display panel or the like, an increased pixel aperture ratio brings about such an effect as reducing electric power consumption by decreasing a light intensity of a BL. Note also that the present invention is not limited to a display device using an oxide semiconductor-TFT, but is applicable to any display device capable of changing a refresh rate.

(Configuration Host Control Section 30)

The host control section 30 includes a screen rewriting detecting section 31, a CPU 32, a host memory 33, a host TG 34 (host timing generator), an image determining section 35, and a control information output section 36. The host control section 30 is configured by, for example, a control circuit provided on a substrate.

The screen rewriting detection section 31 evaluates whether or not an image displayed on the screen of the display section 10 needs to be rewritten. For example, the screen rewriting detection section 31 notifies the CPU 32 of necessity to rewrite displaying (image) of the screen in cases such as (i) a case where an application, which was launched and is being run within the display device 1, notifies the screen rewriting detection section 31 that a displayed image needs be rewritten, (ii) a case where a user of the display device 1 notifies, via an input section, notifies the screen rewriting detection section 31 that a displayed image needs to be rewritten, and (iii) a case where the screen rewriting detection section 31 is notified of the necessity to rewrite a displayed image due to data streaming via the Internet, a broadcast wave, or the like.

Note that image data inputted in the screen rewriting detection section 31 includes (i) data on a displayed image to be rewritten in a frame and (ii) an image rewriting flag (time reference) indicative of a timing with which to display the image data. In a case where content of an image is not changed over a plurality of frames, data in frames in which the content of the image is not changed is not included in the image data. Based on the image rewriting flag, the screen rewriting detection section 31 can detect the necessity to rewrite a displayed image. The screen rewriting detection section 31 stores time of a frame at which the content of the image was changed. Then, based on the image rewriting flag, the screen rewriting detection section 31 evaluates an interval between (i) a given frame in which the content of the image was changed (frame in which the displayed image was rewritten) and (ii) a following frame in which the content of the image was changed next. Based on the interval, it is possible to determine whether the displayed image is a moving image or a still image. The screen rewriting detection section 31 supplies the image rewriting flag and the image data to the CPU 32. In addition, the screen rewriting detection section 31 supplies, to the control information output section 36, data on the interval at which the content of the image is changed.

Note that in a case where the image data does not include an image rewriting flag but includes data on all frames, the screen rewriting detection section 31 can determine, by comparing an image in a given frame and an image in a following frame, whether or not content of the image is changed. Based on a result of the comparison, the screen rewriting detection section 31 can detect necessity to rewrite a displayed image. In such a case also, the screen rewriting detection section 31 evaluates, based on time of frame at which the displayed image is rewritten, an interval between (i) a frame in which the content of the image was changed and (ii) a following frame in which the content of the image was changed next.

The CPU 32 (*i*) obtains, from the screen rewriting detection section 31, the image data of one entire screen and then (ii) writes the image data into the host memory 33. The CPU 32 also supplies the image data to the image determining section 35. The CPU 32 also supplies the rewriting flag to the host TG 34.

The host memory 33 is a storage device configured by a VRAM (Video Random Access Memory) or the like.

When the host TG 34 receives the rewriting flag from the CPU 32, the host TG 34 (*i*) obtains the image data from the host memory 33 and (ii) transfers the image data to the display driving section 20. Only in a case where a displayed image needs to be rewritten, the host TG 34 transfers, to the display driving section 20, image data on the image is to be rewritten in a frame. The host TG 34 transfers the image data in accordance with data communication specifications of a mobile device, such as MIPI (Mobile Industry Processor Interface). Note that the host TG 34 transfers, to the display driving section 20, a sync signal along with the image data.

The image determining section 35 determines whether or not an image based on the image data is an image in which flicker easily occurs. Specifically, the image determining section 35 determines whether or not pixels in the image have grayscale levels falling within a range (flickering grayscale range) of grayscale level 20 to grayscale level 80. The image determining section 35 determines a percentage of pixels, of all pixels falling within a predetermined region, which have grayscale levels falling within the flickering grayscale range. Specifically, the image determining section 35 (*i*) generates a histogram in which pixels of every 10 grayscale levels are categorized into a corresponding one of classes and (ii) determines, based on the histogram, a percentage of pixels having grayscale levels within the flickering grayscale range. Although the predetermined region is herein assumed to be an entire region of the image, the predetermined region can be a partial region of the image. The image determining section 35 determines whether or not the percentage of the pixels having grayscale levels within the flickering grayscale range is equal to or higher than 30% (first threshold value). In a case where the percentage is equal to or higher than 30%, the image determining section 35 determines that flicker easily occurs in the image. In a case where the percentage is lower than 30%, the image determining section 35 determines that flicker does not easily occurs in the image. The image determining section 35 supplies, to the control information output section 36, a determined result indicative of whether or not the percentage of the pixels having grayscale levels within the flickering grayscale range is equal to or higher than the first threshold value. Values of the flickering grayscale range and the first threshold value are illustrative only, and can be other values.

According to the configuration, a threshold value (the first threshold value) is set for the percentage of the pixels having grayscale levels within the flickering grayscale range (such pixels are hereinafter simply referred to as "flickering pixels"). Thus, proper setting of the first threshold value by an experiment or the like can prevent a process that is carried out with respect to a flickering image from being carried out with respect to an image in which no flicker is recognized by a user. Thus, no unnecessary process needs to be carried out, so that still lower electric power consumption can be achieved.

In order to cause the display section 10 to display an image at a refresh rate that is equal to or lower than a predetermined refresh rate (a refresh rate exemplified by but not limited to a refresh rate that is equal to or lower than 10 Hz), the image determining section 35 may determine whether or not the image is a flickering image. With the configuration, in a case where the predetermined refresh rate serving as a threshold against which to determine whether or not flicker is easily recognizable is properly set by an experiment or the like, determination of whether an image is a flickering image does not need to be unnecessarily carried out with respect to a case where the display section 10 is driven at a refresh rate at which a user recognizes no flicker. This makes it possible to further reduce electric power consumption.

The control information output section 36 sets a refresh rate at which to drive the display section 10, and notifies the display driving section 20 of the refresh rate. In accordance with a result of the determination by the image determining section 35, the control information output section 36 supplies, to the grayscale level control section 80, grayscale level control information for causing the grayscale level control section 80 to carry out control for increasing a grayscale level of an image for which it has been determined that the image is a flickering image, and supplies, to the BL control section 90, luminance control information for causing the BL control section 90 to carry out control for lowering a BL luminance.

The grayscale level control information contains, for example, not only information for increasing respective grayscale level values of a plurality of pixels in an image by a predetermined amount (predetermined percentage) (e.g., information on an amount of change in voltage to be applied to liquid crystal) but also information indicative of an instruction on whether or not to change a grayscale level.

The luminance control information contains, for example, not only information for lowering the BL luminance by a predetermined amount (predetermined percentage) [e.g., information on an amount of change in frequency of a PWM (pulse width modulation) signal] but also information indicative of an instruction on whether or not to change the BL luminance.

The grayscale level control information may also contain information on a degree of change in grayscale level which degree is set so as not to change respective front luminances of a plurality of pixels in an image that is being displayed on the display section 10. Meanwhile, the luminance control information may also contain information on (i) a degree of change in grayscale level which change occurs when control for increasing a grayscale level of a flickering image is carried out, the degree being set so as not to change respective front luminances of a plurality of pixels in an image that is being displayed on the display section 10 and (ii) a degree of change in BL luminance. More specifically, grayscale level changing magnification which prevents a change in front luminance of each pixel and a BL luminance lowering magnification are recorded, the grayscale level changing magnification and the BL luminance lowering magnification being associated with each other in advance. According to the configuration, since a front luminance of each pixel is not changed, it is possible to display an image with more excellent quality.

According to Embodiment 1, in a case where a displayed image is a still image, a refresh rate is set at a first refresh rate (e.g., 1 Hz), which is lower than the predetermined refresh rate. Meanwhile, in a case where the displayed image is a moving image, the refresh rate may be set at a second refresh rate (e.g., 30 Hz). In a case where the displayed image is a moving image, the content of the image is changed at short intervals. This causes flicker to be hardly recognizable even in a case where a large number of pixels have grayscale levels within the flickering grayscale range. Therefore, in a case where, for example, a moving image is rewritten at a frequency of 30 Hz, it is unnecessary to refresh the moving image at 60 Hz which is higher than 30 Hz. In a case where, for example, a moving image is rewritten at a frequency of 15 Hz, it is possible to refresh the moving image at 15 Hz or 30 Hz. The control information output section 36 notifies the display driving section 20 of refresh rate setting information so that the display section 10 is driven at a set refresh rate.

The control information output section 36 of Embodiment 1 supplies, to the grayscale level control section 80 and the BL control section 90, not only the above pieces of information but also an image rewriting flag transmitted from the screen rewriting detection section 31. This allows each of the grayscale level control section 80 and the BL control section 90 to understand whether or not image rewriting has been carried out.

The control information output section 36 of Embodiment 1 does not output the grayscale level control information and the luminance control information in a case where the percentage of the pixels having grayscale levels within the flickering grayscale range is lower than the first threshold value. Meanwhile, the control information output section 36 outputs the grayscale level control information and the luminance control information in a case where the percentage of the pixels having grayscale levels within the flickering grayscale range is equal to or higher than the first threshold value. With the configuration, proper setting of the first threshold value by an experiment or the like can prevent a process that is carried out with respect to a flickering image from being carried out with respect to an image in which no flicker is recognized by a user. Thus, no unnecessary process needs to be carried out, so that still lower electric power consumption can be achieved.

Further, the control information output section 36 of Embodiment 1 does not output the grayscale level control information and the luminance control information in a case where an interval between points in time where the content of an image detected by the screen rewriting detection section 31 is changed is equal to or shorter than a predetermined interval threshold value, or in a case where the interval is longer than the interval threshold value and the percentage of the pixels having grayscale levels within the flickering grayscale range is lower than the first threshold value. Meanwhile, the control information output section 36 outputs the grayscale level control information and the luminance control information in a case where the interval is longer than the interval threshold value and the percentage of the pixels having grayscale levels within the flickering grayscale range is equal to or higher than the first threshold value. With the configuration, proper setting of the interval threshold value by an experiment or the like can prevent a process that is carried out with respect to a flickering image from being carried out with respect to an image which is displayed at an interval between points in time where no flicker is recognized by a user. Thus, no unnecessary process needs to be carried out, so that still lower electric power consumption can be achieved.

(Configuration of Grayscale Level Control Section 80)

The grayscale level control section 80 which has received the image rewriting flag (indicating that image rewriting has been carried out) and the grayscale level control information from the control information output section 36 reads out image data recorded in the host memory 33, and transmits, to the host TG 34, the image data whose grayscale level is increased by a predetermined amount. Such a change in grayscale level is carried out with respect to an entire image. Meanwhile, the grayscale level control section 80 which has received the image rewriting flag (indicating that image rewriting has been carried out) but has not received the grayscale level control information transmits, directly to the host TG 34, image data read out from the host memory 33.

(Configuration of BL Control Section 90)

The BL control section 90 which has received the image rewriting flag (indicating that image rewriting has been carried out) and the luminance control information from the control information output section 36 lowers a BL luminance of the display section 10 from a predetermined set value by a predetermined amount. Meanwhile, the BL control section 90 which has received the image rewriting flag (indicating that image rewriting has been carried out) but has not received the luminance control information sets the BL luminance of the display section 10 at the predetermined set value.

(Configuration Display Driving Section 20)

The display driving section 20 is, for example, a so-called COG driver and is mounted on a glass substrate of the display section 10 by use of a COG (Chip on Glass) technique. The display driving section 20 drives the display section 10 to cause the screen to display an image based on image data. The display driving section 20 includes a memory 21, a TG 22 (timing generator), and a source driver 23.

The memory 21 stores the image data transferred from the host control section 30. The memory 21 then retains the image data until the displayed image is rewritten (i.e. retains the image data unless the content of the image is changed).

Based on the refresh rate instructed by the host control section 30, the TG 22 reads out the image data from the memory 21, and supplies the image data to the source driver 23. In addition, the TG 22 generates a timing signal for driving the display section 10 at the refresh rate instructed by the control information output section 36, and supplies the timing signal to the source driver 23. Note that, for generating the timing signal, the TG 22 can utilize the sync signal supplied from the host TG.

In accordance with the timing signal, the source driver 23 writes, into the pixels of the display section 10, respective display voltages corresponding to the image data.

Suitable examples of the display device 1 encompass display devices that place importance particularly on portability, such as mobile phones, smartphones, notebook-sized PCs, tablet devices, e-book readers, and PDAs.

(Display Driving Method)

Figure 3:
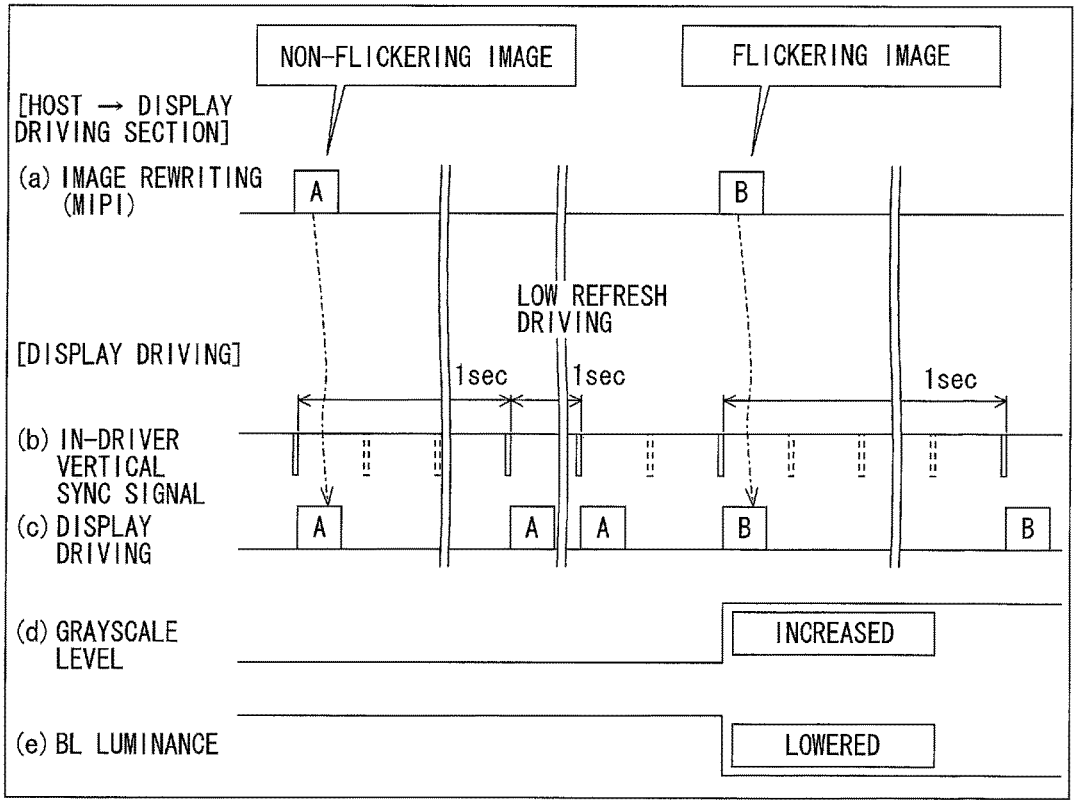
FIG. 3 is a timing chart showing how the display device displays a still image.

FIG. 3 is a timing chart showing how the display device 1 displays a still image. FIG. 3 illustrates a case where a still image A and a still image B are alternately displayed. The image A includes less than the first threshold value of pixels which have grayscale levels falling within a flickering grayscale range (grayscale level 20 to grayscale level 80). This causes flicker to hardly occur in the image A. The image B includes a first threshold value (30%) or a higher percentage of pixels which have grayscale levels falling within the flickering grayscale range. This causes flicker to easily occur in the image B. Therefore, a grayscale level of the image B is increased [see (d) of FIG. 3], whereas a BL luminance is lowered [see (e) of FIG. 3].

The host control section 30 transfers image data (image A or image B) on one entire screen to the display driving section 20 only when content of a screen is changed (see (a) of FIG. 3). After the image data on the image A is transferred, it is when the displayed image is rewritten to the image B that the host control section 30 transfers image data to the display driving section 20 next.

The display driving section 20 (*i*) stores the received image data (image A) in the memory 21 and (ii) rewrites, with a timing synchronized with an in-driver vertical sync signal illustrated in (b) of FIG. 3, the displayed image on the display section 10 to the image A [see (c) of FIG. 3]. The in-driver vertical sync signal is generated by the TG 22 every predetermined time (every second). Note that the description of a delay time between a point in time where the display driving section 20 receives the image data and a point in time where the image is displayed will be omitted. A pulse shown by dotted lines indicates points in time where vertical sync signals are not generated.

Then, the image A thus displayed is refreshed every second (at 1 Hz). Specifically, the display driving section 20 operates such that the TG 22 reads out image data (image A) from the memory 21 every second, and then the source driver 23 supplies the image data to the display section 10.

The display driving section 20 which has received the image data indicative of the image B rewrites an image displayed on the display section 10 to the image B regardless of a refresh rate. Thereafter, the image B thus displayed is refreshed every second. Specifically, the display driving section 20 operates such that the TG 22 reads out image data (image B) from the memory 21 every second, and then the source driver 23 supplies the image data to the display section 10. In so doing, an in-driver vertical sync signal is also generated along with the refresh rate of 1 Hz.

Figure 4:
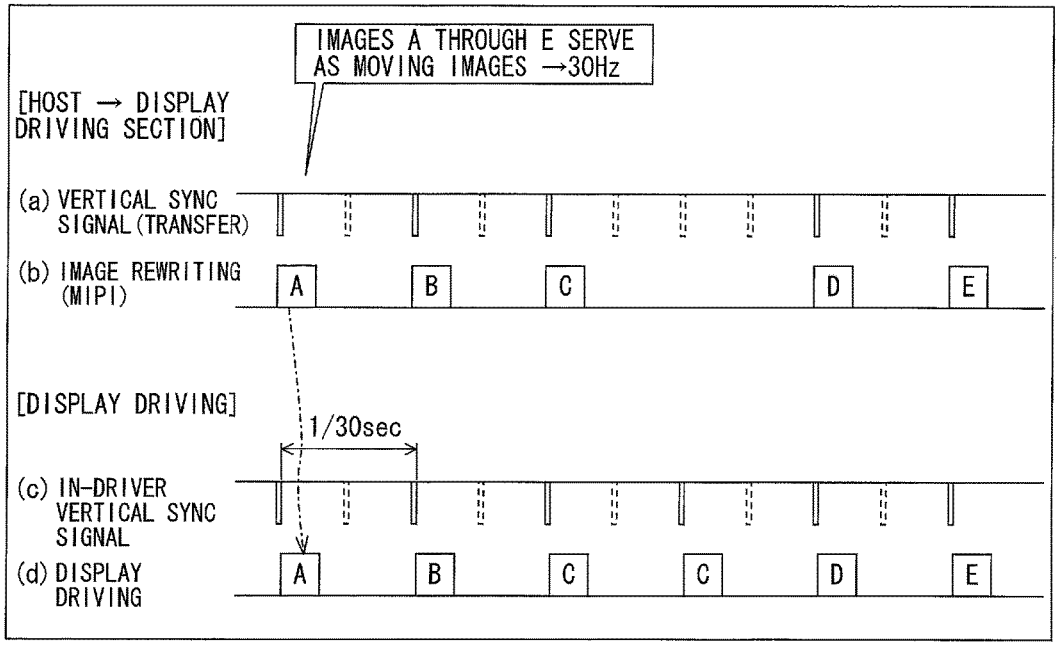
FIG. 4 is a timing chart showing how the display device displays a moving image.

FIG. 4 is a timing chart showing how the display device 1 displays a moving image. FIG. 4 illustrates a case where images A through E, which serve as moving images, are displayed in turn. The images A, B, D, and E are each displayed for 1/30 seconds, whereas the image C is displayed for 1/15 seconds. Intervals, at which content of the moving images is changed from one image to another, are each equal to or shorter than an interval threshold value (e.g. 400 ms). Therefore, since it is determined that the images A through E serve as moving images, the control information output section 36 does not output the grayscale level control information and the luminance control information.

Only when the content of an image is changed, the host control section 30 transfers, with a timing synchronized with a vertical sync signal (transfer), image data (images A through E) of one entire screen to the display driving section 20 (see (a) and (b) of FIG. 4).

The display driving section 20 (*i*) stores the received image data (image A) in the memory 21 and (ii) rewrites, with a timing synchronized with an in-driver vertical sync signal illustrated in (c) of FIG. 4, the displayed image on the display section 10 to the image A [see (d) of FIG. 4]. The in-driver vertical sync signal is generated by the TG 22 in accordance with a timing with which to receive display data from the host control section 30.

(Flow of Process of Controlling Grayscale Level and BL Luminance)

Figure 5:
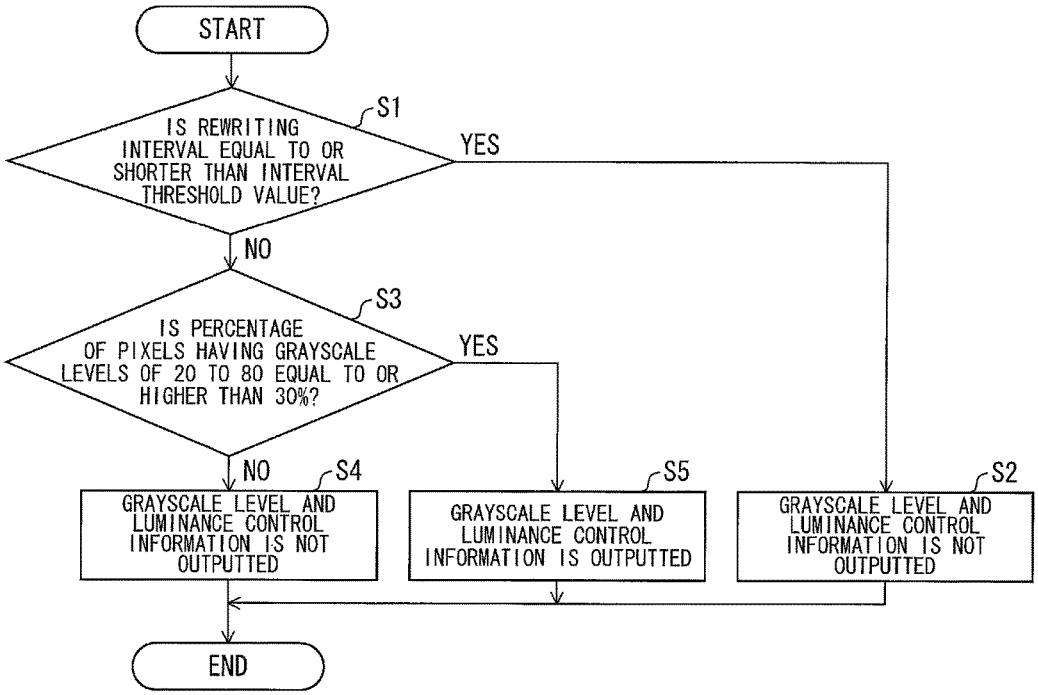
FIG. 5 is a flow chart, for the display device, of a process in which it is determined whether to output grayscale level and luminance control information.

FIG. 5 is a flow chart of a process in which the host control section 30 controls a grayscale level and a BL luminance. The flow illustrated in FIG. 5 is carried out each time the screen rewriting detection section 31 detects rewriting of a displayed image (i.e. detects a change in content of the image). In this case, the screen rewriting detection section 31 supplies, to the control information output section 36 (and the CPU 32), information indicative of whether or not image rewriting has been carried out, e.g., an image rewriting flag (indicating that image rewriting has been carried out; e.g., "1") and an image rewriting flag (indicating that image rewriting has not been carried out; e.g., "0").

When the screen rewriting detection section 31 detects, based on an image rewriting flag or the like, a change in content of an image, the screen rewriting detection section 31 evaluates an interval between points in time at which the content of the image is changed. Then, the control information output section 36 determines whether or not the interval (rewriting interval) is equal to or shorter than a predetermined interval threshold value (e.g. 400 ms) (S1).

In a case where the interval between points in time at which the content of the image is changed is equal to or shorter than the interval threshold value (Yes in S1), the control information output section 36 determines that a displayed image is a moving image, and therefore does not output grayscale level and luminance control information (S2).

In a case where the interval between points in time at which the content of the image is changed is longer than the interval threshold value (No in S1), the control information output section 36 determines that the displayed image is a still image. Then, the image determining section 35 determines a percentage of pixels, of all pixels included in the image, which have grayscale levels falling within a flickering grayscale range (range of grayscale level 20 to grayscale level 80). Then, the image determining section 35 determines whether or not the percentage is equal to or higher than a first threshold value (30%) (S3).

In a case where (i) the interval between points in time at which the content of the image is changed is longer than the interval threshold value and (ii) the percentage of the pixels having grayscale levels within the flickering grayscale range is lower than the first threshold value (30%) (No in S3), the control information output section 36 does not output the grayscale level and luminance control information (S4).

In a case where (i) the interval between points in time at which the content of the image is changed is longer than the interval threshold value and (ii) the percentage of the pixels having grayscale levels within the flickering grayscale range is equal to or higher than the first threshold value (30%) (Yes in S3), the control information output section 36 outputs the grayscale level and luminance control information (S5).

(Effect of Display Device 1)

Flicker, whose recognizability greatly depends on a grayscale level, tends to be remarkably easily recognizable when the grayscale level is an intermediate grayscale level (recognizable on the lower grayscale level side especially at an intermediate grayscale level equal to or higher than grayscale level 10). In view of this, according to Embodiment 1, in a case where the image determining section 35 determines that an image is a flickering image, the control information output section 36 outputs the grayscale level control information so as to control the grayscale level control section 80 so that a grayscale level of the image is increased. This prevents recognizability of flicker due to an image that includes a large number of pixels having grayscale levels falling within the flickering grayscale range.

A flickering grayscale level is constant regardless of a BL luminance. Note, however, that flicker tends to be hardly recognizable to human eyes in a case where the BL luminance is low. In view of this, according to Embodiment 1, in a case where the image determining section 35 determines that an image is a flickering image, the control information output section 36 outputs the luminance control information so as to control the BL control section 90 so that the luminance is lowered. This can prevent recognizability of flicker due to a high BL luminance.

Further, as described earlier, the grayscale level (i.e., a transmittance of a pixel) is increased and the BL luminance is lowered (e.g., a BL luminance of 300 cd/m$^2$ and grayscale level 60 are changed to a BL luminance of 150 cd/m$^2$ and grayscale level 120, respectively), so that each pixel is prevented from changing in front luminance before and after a change in grayscale level and BL luminance. Thus, a deterioration in display quality can also be prevented.

Meanwhile, flicker, whose recognizability also greatly depends on a drive frequency, tends to be remarkably easily recognizable as a refresh rate is lowered. Thus, in a case where the grayscale level and luminance control information is outputted, the display section 10 is normally highly likely to be subjected to low refresh driving. The display section 10 which is subjected to low refresh driving is driven at low electric power, and electric power consumed by the BL is more dominant than the electric power at which the display section 10 is driven. In view of this, according to Embodiment 1, in a case where the image determining section 35 determines that an image is a flickering image (in this case, it is normally considered that the display section is subjected to low refresh driving), the BL luminance is lowered. This makes it possible to obtain not only an effect, yielded by low refresh driving, of reducing electric power consumption, but also an effect, yielded by lowering of the BL luminance, of reducing electric power consumption. Such a configuration as described above makes it possible to suppress electric power consumption as well as display an image with excellent quality.

(Modification 1)

A single picture element includes R, G, and B pixels. In the example above, the image determining section 35 determines the percentage of pixels, of all pixels in an image, which have grayscale levels within the flickering grayscale range, regardless of colors of the pixels (RGB).

Alternatively, the image determining section 35 can (i) determine respective percentages of R, G, and B pixels having grayscale levels within a flickering grayscale range and (ii) determine respective weighted values of the percentages. In such a case, the image determining section 35 determines whether or not a sum of the weighted values is equal to or higher than a predetermined threshold value. Degrees to which an ordinary person can recognize (visually sense) R, G, and B colors are said to be in a ratio of 3:6:1. That is, an ordinary person clearly recognizes G (green) pixels. This means that flicker is easily recognizable if a large number of G pixels have grayscale levels within the flickering grayscale range. Therefore, the image determining section 35 determines (i) a percentage Rr of R (red) pixels, of all R pixels in a predetermined region of the image, which have grayscale levels within the flickering grayscale range, (ii) a percentage Rg of G pixels, of all G pixel in the predetermined region, which have grayscale levels within the flickering grayscale range, and (iii) a percentage Rb of B pixels, of all B pixels in the predetermined region, which have grayscale levels within the flickering grayscale range. Then, the image determining section 35 determines, as the sum of the weighted values, a value obtained by $(3\times Rr)+(6\times Rg)+(1\times Rb)$. In a case where the sum is equal to or higher than a predetermined threshold value (e.g. a value obtained by $(3+6+1)\times 30[\%]$), the image determining section 35 can determine that flicker is easily recognizable in the image.

Alternatively, whether or not flicker is easily recognizable in an image can be determined by the image determining section 35, based on luminances Y of respective picture elements determined from R, G, and B grayscale levels. Specifically, the image determining section 35 determines the luminances Y of the respective picture elements where, for example, luminance Y=R grayscale×0.29891+G grayscale×0.58661+B grayscale×0.11448. In a case where a luminance Y of a corresponding one of the picture elements falls within a predetermined range (e.g. 20 to 80), the image determining section 35 can determine that pixels included in the picture element have grayscale levels within the flickering grayscale range. That is, in a case where a first threshold value (30%) or a higher percentage of picture elements have luminances Y falling within the predetermined range, in order that flicker is prevented from being recognized, a grayscale level of the image is increased, and a BL luminance is lowered. In such a case, since the image determining section 35 only needs to store a histogram indicative of luminances Y of the picture elements, a storage capacity only needs to be approximately ⅓ of a storage capacity required in a case where the image determining section 35 stores a histogram indicative of grayscale levels of the respective pixels.

Embodiment 2

(Image Determining Method 1)

In Embodiment 1, what is determined is the percentage of pixels, of all the pixels included in an image, which have grayscale levels falling within a predetermined range. Alternatively, it is possible to determine the percentage of pixels, of all pixels included in part of an image, which have grayscale levels falling within a predetermined range.

Figure 6:
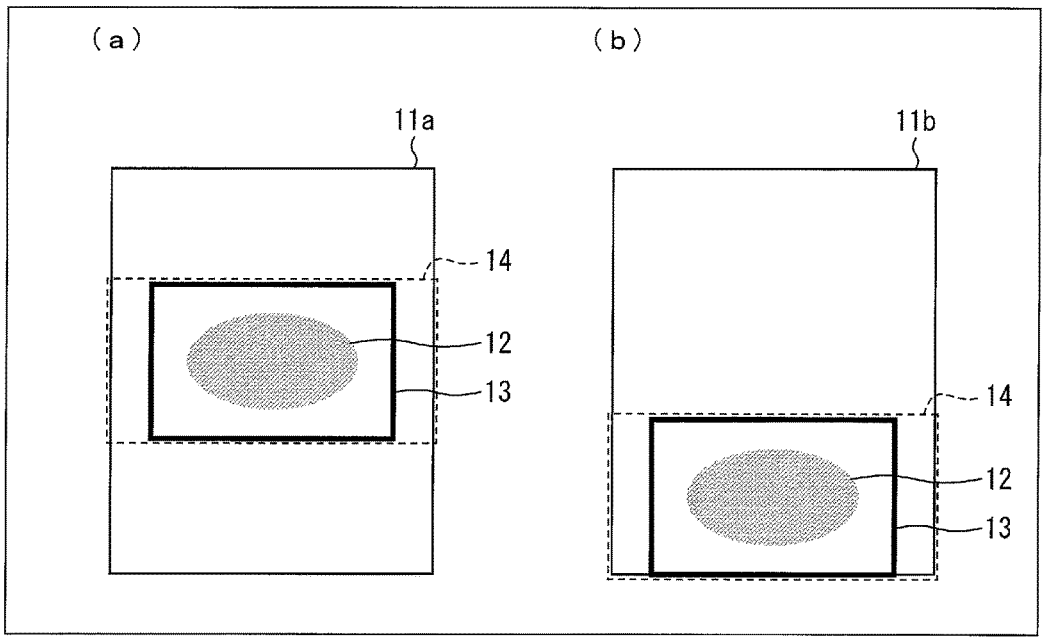
FIG. 6 is a view illustrating screens of the display device.

(a) and (b) of FIG. 6 are views illustrating screens of respective display devices. Uniformity across capacitances of respective pixels depends on a production process. Therefore, a region of a screen of a display device, which region includes pixels having non-uniform capacitances, tends to be concentrated in a certain region. In the example of the display device in (a) of FIG. 6, for example, a region 12, which includes pixels having non-uniform capacitances, is located at a central part of a screen 11*a*. In the example of the display device in (b) of FIG. 6, a region 12, which includes pixels having non-uniform capacitances, is located at a lower part of a screen 11*b*. That is, even in a case where an entire part of a screen displays an image having uniform grayscale levels, (i) flicker in the example shown in (a) of FIG. 6 is easily recognizable at the central part of the screen 11*a* and (ii) flicker in the example shown in (b) of FIG. 6 is easily recognizable in the lower part of the screen 11*b*.

Therefore, it is to be determined whether or not pixels having such grayscale levels that cause flicker to easily occur are distributed throughout a region of the image, which region corresponds to the region 12 including pixels having non-uniform capacitances. This makes it possible to determine whether or not the flicker easily occurs in the image.

According to the display device illustrates in (a) of FIG. 6, an image determining section 35 (region specifying section) specifies, as a predetermined analysis region 13, a partial region located at the central part of the image. According to the display device illustrated in (b) of FIG. 6, an image determining section 35 specifies, as a predetermined analysis region 13, a partial region located at the lower part of the image. Each of the respective analysis regions 13 of (a) and (b) of FIG. 6 includes a region corresponding to the region 12. The image determining section 35 determines whether or not a first threshold value (e.g. 30%) or a higher percentage of pixels, of all the pixels in the analysis region 13, have grayscale levels falling within a flickering grayscale range (e.g. in a range of range of grayscale level 20 to grayscale level 80).

The percentage of pixels having intermediate grayscale levels is thus determined only in a partial region of the image, which partial region corresponds to a region of a screen, which region causes flicker to easily occur. This allows for a reduction in amount of process of determining grayscale levels of pixels. In addition, it is possible to reduce a storage capacity that is required for a histogram.

(Image Determining Method 2)

Alternatively, whether or not an image includes a region in which flicker easily occurs can be determined by determining whether or not the image includes a region that matches a predetermined pattern.

Figure 7:
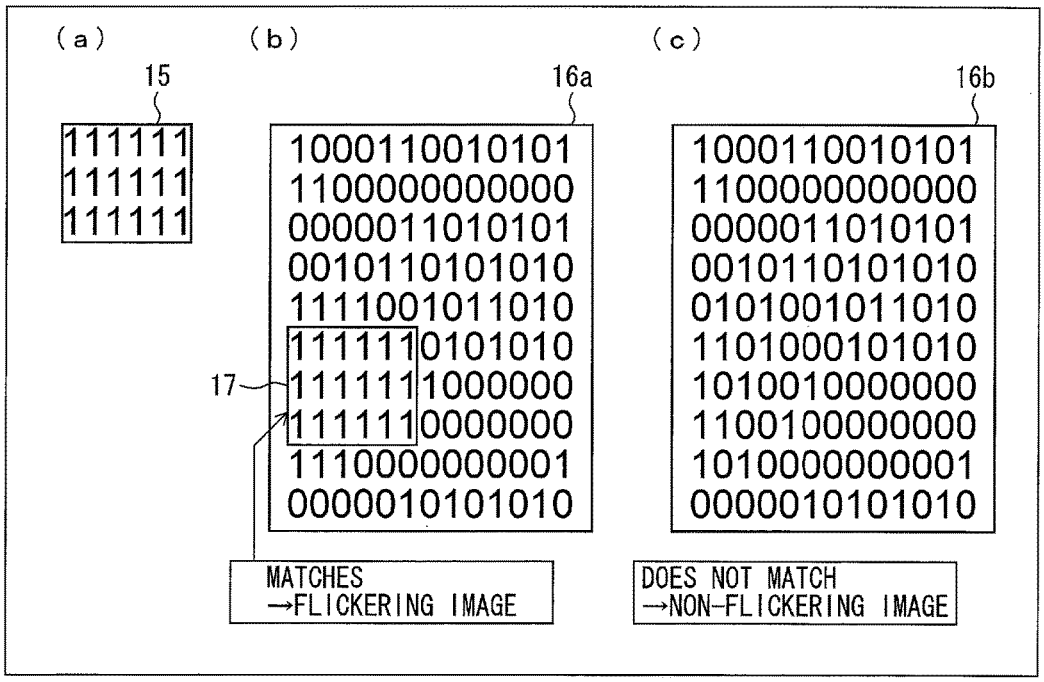
FIG. 7 is a set of views for explaining a method for determining, in the display device by pattern matching, whether an image is a flickering image. (a) of FIG. 7 illustrates a predetermined pattern. (b) and (c) of FIG. 7 each illustrate a grayscale map indicative of grayscale levels of respective pixels in an image.

(a) of FIG. 7 is a view illustrating a predetermined pattern 15. The pattern 15 is a rectangular pattern made up of 3 lines×6 rows of pixels. The number "1" indicates that a corresponding pixel has a grayscale level falling within a flickering grayscale range (range of grayscale level 20 to grayscale level 80). The number "0" indicates that a corresponding pixel has a grayscale level falling outside the flickering grayscale range. That is, the pattern 15 is a pattern made up of pixels which have grayscale levels within the flickering grayscale range and which are two-dimensionally arranged.

(b) and (c) of FIG. 7 are views each illustrating a grayscale map indicative of grayscale levels of respective pixels in an image. The image determining section 35 (*i*) determines whether or not pixels in images have grayscale levels within a flickering grayscale range and (ii) generates respective grayscale maps 16*a* and 16*b*. In each of the grayscale maps 16*a* and 16*b*, pixels having grayscale levels within the flickering grayscale range are indicated as "1", whereas pixels having grayscale levels outside the flickering grayscale range are indicated as "0."

As shown by the grayscale map 16*b* in (c) of FIG. 7, even in a case where a large number of pixels have grayscale levels within the flickering grayscale range, flicker is hardly recognizable if such pixels are sparsely dispersed. As shown by the grayscale map 16*a* in (b) of FIG. 7, in a case where a region is locally present in which pixels having grayscale levels within the flickering grayscale range are closely distributed, then flicker is easily recognizable even if a small percentage of pixels of the entire pixels have grayscale levels within the flickering grayscale range. In other words, if pixels having grayscale levels within the flickering grayscale range are concentrated in an area that is equal to or larger than a certain region, then flicker is more easily recognizable.

The image determining section 35 determines whether or not each of the grayscale maps 16*a* and 16*b* includes a region that matches the predetermined pattern 15. The control information output section 36 outputs a grayscale level and luminance control signal in accordance with whether or not the image includes the region matching the pattern 15.

The grayscale map 16*a* of a given image includes a region 17 that matches the pattern 15. Therefore, the image corresponding to the grayscale map 16*a* causes flicker to easily occur. Therefore, the control information output section 36 determines that the grayscale level and luminance control signal is to be outputted. The grayscale map 16*b* of another image includes no region that matches the pattern 15. Therefore, the image corresponding to the grayscale map 16*b* causes flicker to hardly occur. Therefore, the control information output section 36 determines that the grayscale level and luminance control signal is not to be outputted.

It is thus determined according to whether or not an image includes a region that matches the predetermined pattern 15 whether or not the grayscale level and luminance control signal is to be outputted. Therefore, prevention of recognition of flicker and maintenance of display quality can be achieved by (i) increasing a grayscale level of an image (e.g. image in (b) of FIG. 7) having a local region in which flicker is easily recognizable and (ii) lowering a BL luminance. In addition, occurrence of a wasteful process is prevented by carrying out no grayscale level and luminance control with respect to an image (e.g. image in (c) of FIG. 7) (i) which includes a large number of pixels having grayscale levels within the flickering grayscale range and (ii) in which flicker is hardly recognizable.

Alternatively, it is possible that, even in a case where a matching rate by which a region included in the image matches the pattern 15 is not 100%, the control information output section 36 determines that the grayscale level and luminance control signal is to be outputted if the matching rate is equal to or higher than a predetermined matching rate (e.g. 80%).

Note that in the above described examples, pattern matching is carried out regardless of colors of the pixels. Alternatively, it is possible to carry out pattern matching for each picture element. Specifically, the image determining section 35 can (i) generate a grayscale map indicative of whether or not luminances Y of respective picture elements fall within a predetermined range and (ii) determine whether or not a predetermined pattern constituted by the plurality of picture elements matches an image. Alternatively, the image determining section 35 can (i) generate grayscale maps corresponding to respective R, G, and B colors of a single image and (ii) determine whether or not each of the grayscale maps of the respective colors matches a predetermined pattern.

Embodiment 3

According to Embodiment 3, an image determining section and a control information output section for determining whether or not to carry out grayscale level and luminance control are provided in a substrate other than a host control section.

(Configuration of Display Device 2)

Figure 9:
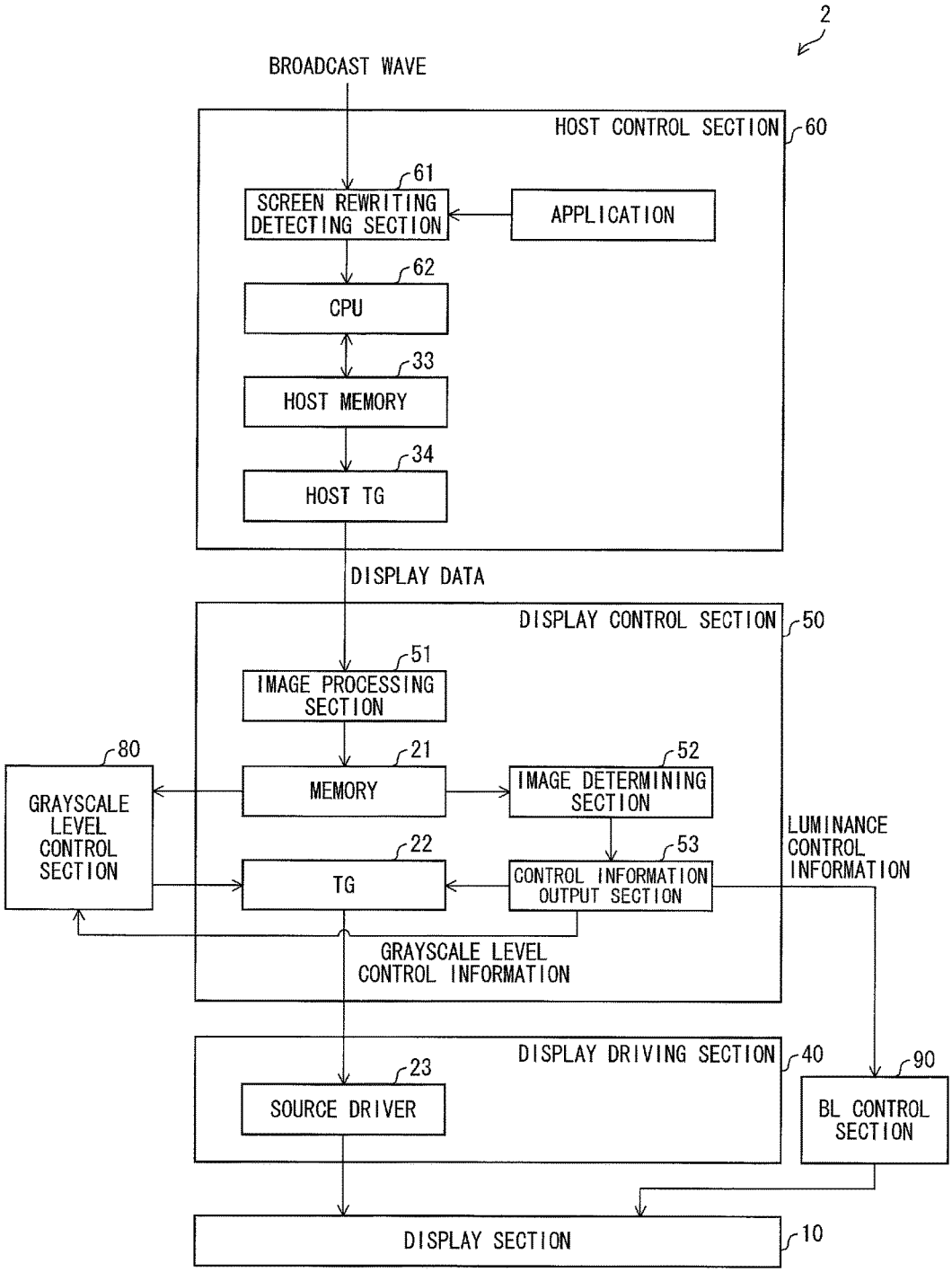
FIG. 9 is a block diagram illustrating a configuration of a display device in accordance with another aspect of the present invention.

FIG. 9 is a block diagram illustrating a configuration of a display device in accordance with Embodiment 3. A display device 2 includes a display section 10, a display driving section 40, a display control section 50 (control device), a host control section 60, a grayscale level control section 80, and a BL control section (backlight control section) 90.

As with Embodiment 1, the display driving section 40 is a COG driver mounted on a glass substrate of the display section 10 by use of the COG technique, and drives the display section 10. The host control section 60 is a control substrate configured by a control circuit provided on a substrate, and is a main component for controlling a host side of the display device 2. The display control section 50 is a control substrate provided apart from the host control section 60 for processing a displayed image and the like. According to Embodiment 3, it is the display control section 50 that determines whether or not to carry out grayscale level and luminance control. This allows for a reduction in load of the host control section 60, and therefore makes it possible to secure performance of the host control section 60 for carrying out a process other than displaying an image.

(Configuration of Host Control Section 60)

The host control section 60 includes a screen rewriting detection section 61, a CPU 62, a host memory 33, and a host TG 34.

The screen rewriting detection section 61 may or may not evaluate an interval between points in time at which content of an image is changed and then notify the display control section 50 of the interval. For example, the evaluation of the interval can be carried out on a display-control-section-50 side. Any other process of the screen rewriting detection section 61 is carried out as is the case of the screen rewriting detection section 31 of Embodiment 1.

The CPU 62 carries out processes similar to those carried out by the CPU 32 of Embodiment 1 except that the CPU 62 does not supply image data to an image determining section.

Only in a case where a displayed image needs to be rewritten, the host TG 34 transfers image data on the image to the display control section 50.

(Configuration of Display Control Section 50)

The display control section 50 includes an image processing section 51, an image determining section 52, a control information output section 53, a memory 21, and a TG 22.

The image processing section 51 subjects, to image processing such as color adjustment, the image data received from the host control section 60. The image processing section 51 then writes, into the memory 21, the image data which has been subjected to the image processing.

When the image data stored in the memory 21 is rewritten, the image determining section 52 obtains the image data from the memory 21. The image determining section 52 determines whether or not an image based on the image data is an image in which flicker easily occurs. The determining process of the image determining section 52 is similar to the process described in the preceding embodiments. The image determining section 52 then supplies a determined result to the control information output section 53. The image determining section 52 (rewriting detection section) can also (i) evaluate an interval between points in time at which content of the image is changed and (ii) supply data on the interval to the control information output section 53.

The control information output section 53 sets a refresh rate at which to drive the display section 10, and notifies the TG 22 of the refresh rate. In accordance with a result of the determination by an image determining section 35, the control information output section 53 supplies, to the grayscale level control section 80, grayscale level control information for causing the grayscale level control section 80 to carry out control for increasing a grayscale level of an image for which it has been determined that the image is a flickering image, and supplies, to the BL control section 90, luminance control information for causing the BL control section 90 to carry out control for lowering a BL luminance.

The grayscale level control section 80 which has received the image rewriting flag (indicating that image rewriting has been carried out) and the grayscale level control information from the control information output section 53 reads out image data recorded in the memory 21, and transmits, to the TG 22, the image data whose grayscale level is increased by a predetermined amount. Meanwhile, the grayscale level control section 80 which has received the image rewriting flag (indicating that image rewriting has been carried out) but has not received the grayscale level control information transmits, directly to the TG 22, image data read out from the memory 21.

The BL control section 90 which has received the image rewriting flag (indicating that image rewriting has been carried out) and the luminance control information from the control information output section 53 lowers a BL luminance of the display section 10 by a predetermined amount. Meanwhile, the BL control section 90 which has received the image rewriting flag (indicating that image rewriting has been carried out) but has not received the luminance control information sets the BL luminance of the display section 10 at a predetermined set value.

The TG 22 (*i*) receives the image data from the grayscale level control section 80 and (ii) transfers the image data to a source driver 23 of the display driving section 40 in accordance with the refresh rate instructed by the control information output section 53. Note that the TG 22 transfers, in line with the refresh rate, the image data to the display driving section 40 regardless of whether or not an image stored in the memory 21 has been rewritten.

The display driving section 40 includes the source driver 23. A configuration of the source driver 23 is similar to that in Embodiment 1.

Embodiment 4

According to Embodiment 4, an image determining section and a control information output section for determining whether or not to carry out grayscale level and luminance control are provided in a display driving section which is a COG driver.

(Configuration Display Device 3)

Figure 10:
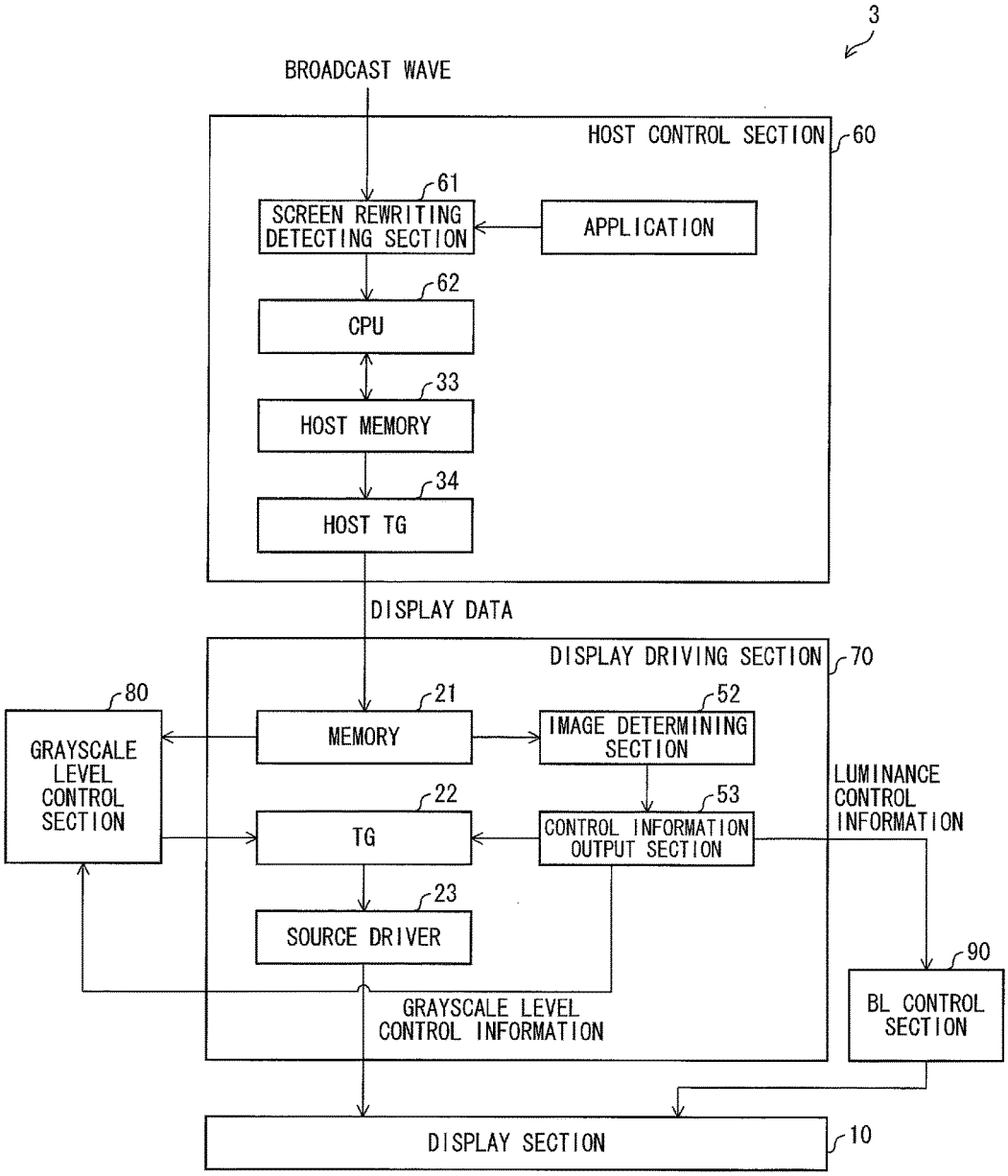
FIG. 10 is a block diagram illustrating a configuration of a display device in accordance with a further aspect of the present invention.

FIG. 10 is a block diagram illustrating a configuration of a display device in accordance with Embodiment 4. A display device 3 includes a display section 10, a display driving section 70 (control device), a host control section 60, a grayscale level control section 80, and a BL control section (backlight control section) 90. A configuration of the host control section 60 is similar to that in Embodiment 3. Only in a case where a displayed image needs to be rewritten, the host control section 60 transfers image data on the image to the display driving section 70.

The display driving section 70 is a COG driver mounted on a glass substrate of the display section 10 by use of the COG technique, and drives the display section 10. The display driving section 70 includes an image determining section 52, a control information output section 53, a memory 21, a TG 22, and a source driver 23. Operations of the members includes in the display driving section 70 are similar to those described in Embodiment 3.

According to Embodiment 4, it is the COG driver (display driving section 70) that determines whether or not to carry out grayscale level and luminance control. This makes it possible to reduce a load of the host control section 60 without providing a substrate in addition to the host control section 60. Note that a surface area by which the COG driver is mounted on an active matrix substrate is limited. Therefore, Embodiment 4 is suitable for a case where the image determining section 52 and the control information output section 53 carry out a simple determining process.

Embodiment 5

A display device 4 of Embodiment 5 differs from the display device 1 of Embodiment 1 in that the display device 4 further includes an illuminance sensing section 100 and a grayscale range control section 110. Note that Embodiment 5 realizes an aspect obtained by adding the illuminance sensing section 100 and the grayscale range control section 110 to the display device 1 of Embodiment 1. Alternatively, Embodiment 5 may realize an aspect obtained by adding the illuminance sensing section 100 and the grayscale range control section 110 to each of the display device 2 and the display device 3, which are described earlier.

(Configuration of Display Device 4)

Figure 11:
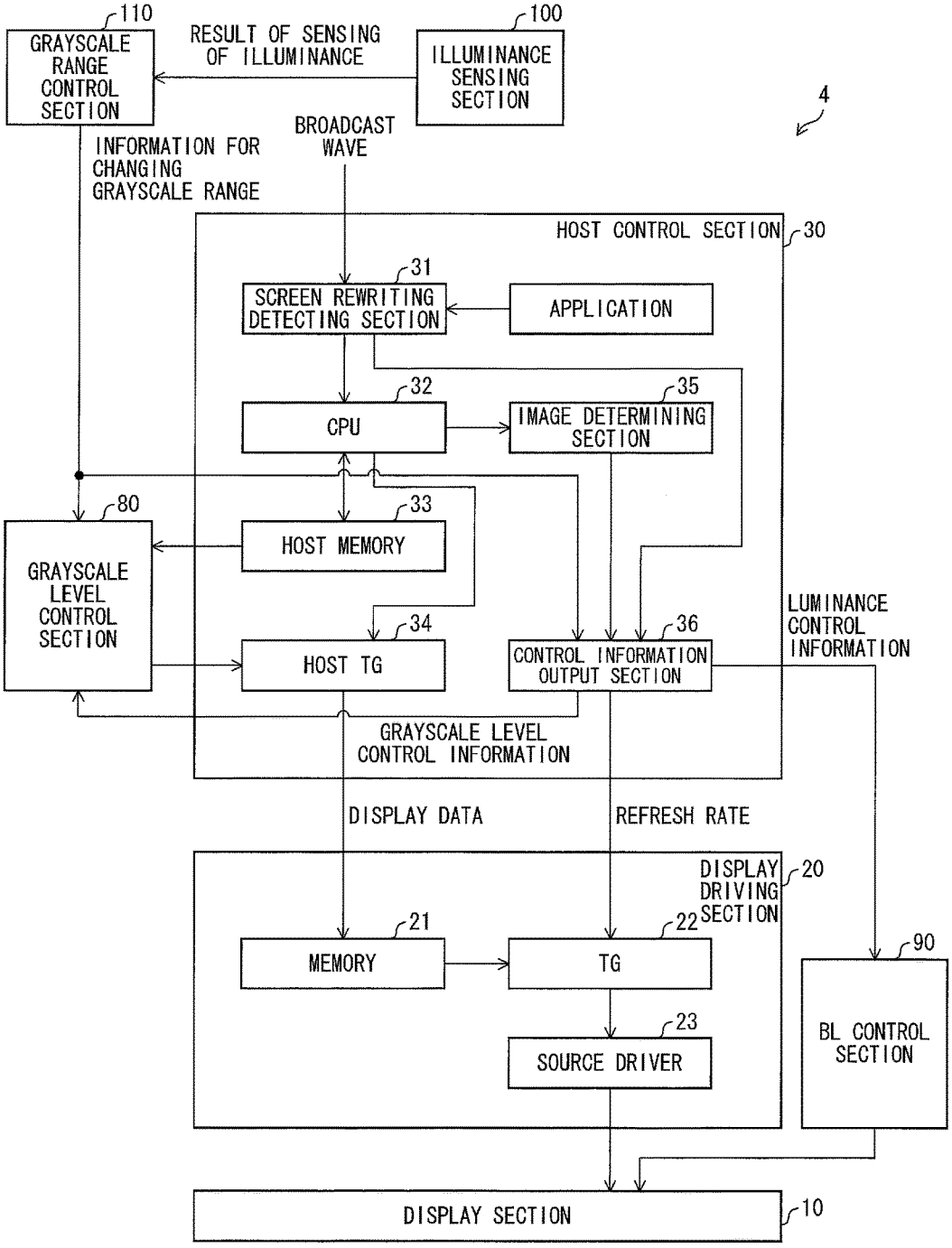
FIG. 11 is a block diagram illustrating a configuration of a display device in accordance with a further aspect of the present invention.

FIG. 11 is a block diagram illustrating a configuration of a display device in accordance with Embodiment 5. The display device 4 is identical to the display device 1 in configuration other than those of the illuminance sensing section 100 and the grayscale range control section 110. The illuminance sensing section 100, which is, for example, an illuminance sensor, senses an illuminance of an area around the display device 4.

An ambient illuminance and a flickering grayscale range have a correlation therebetween. In a case where a surrounding area is bright, flicker tends to be hardly recognizable. In view of this, in a case where the grayscale level and luminance control (described earlier) is more minutely carried out by use of brightness information from the illuminance sensing section 100, it is possible to further reduce flicker.

Figure 8:
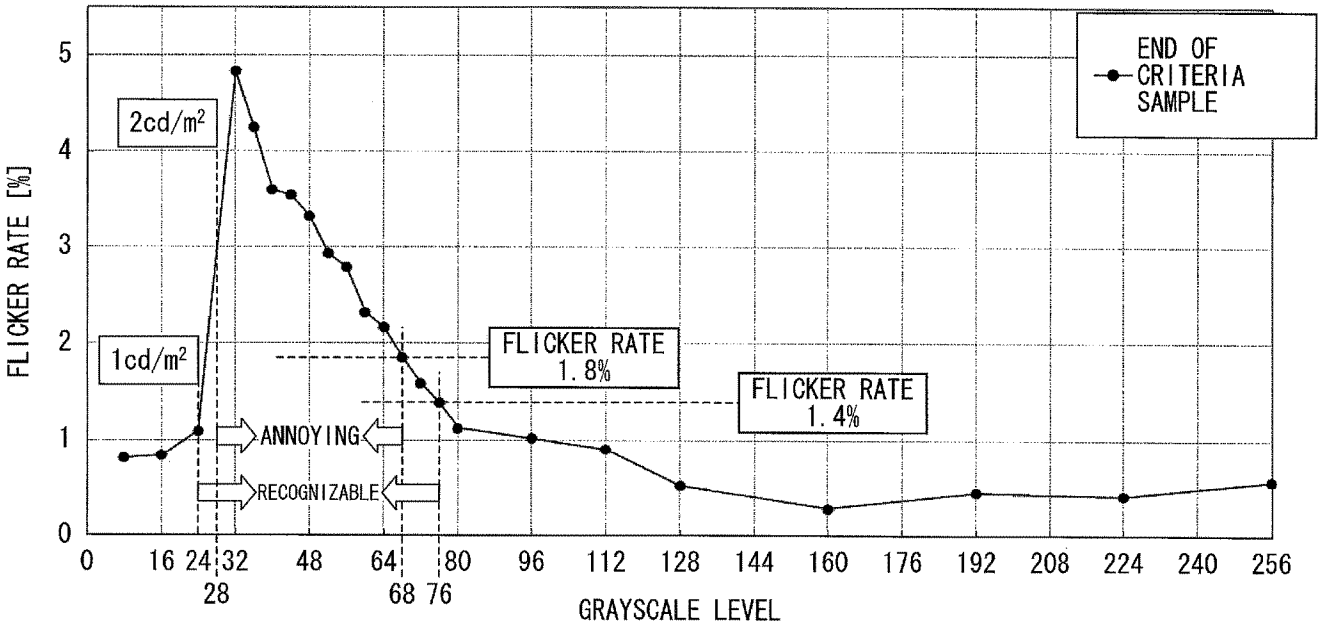
FIG. 8 is a set of views for explaining a relationship between an ambient illuminance and a flickering grayscale level. (a) of FIG. 8 is a graph showing a flicker rate with respect to a grayscale level. (b) of FIG. 8 is a table showing a relationship between an ambient environment and a flickering grayscale level.

Here, as illustrated in (a) and (b) of FIG. 8, recognizability of flicker is subjectively evaluated under the following conditions (1) to (3):

(1) darkroom (0 lx)+maximum brightness (400 cd/m$^2$; condition under which flicker is most easily recognizable)

(2) indoors (600 lx)+automatically-controlled brightness (140 cd/m$^2$; condition of normal use)

(3) outdoors (2000 lx)+maximum brightness (400 cd/m$^2$; condition under which flicker is hardly recognizable)

Under the condition (1), a percentage of pixels which have grayscale levels falling within a range of grayscale level 20 to grayscale level 80 is high (equal to or higher than 30%), flicker is recognizable, and a percentage of pixels which have grayscale levels falling within a range of grayscale level 24 to grayscale level 76 is high, flicker is annoying.

Under the condition (2), a percentage of pixels which have grayscale levels falling within a range of grayscale level 24 to grayscale level 76 is high (equal to or higher than 30%), flicker is recognizable, and a percentage of pixels which have grayscale levels falling within a range of grayscale level 28 to grayscale level 68 is high, flicker is annoying.

Under the condition (3), no flicker is recognizable.

As illustrated in (a) of FIG. 8, in a case where an ambient illuminance is higher, an upper-limit flickering grayscale level in the flickering grayscale range tends to shift to a lower level, and a lower-limit flickering grayscale level in the flickering grayscale range tends to shift to a higher level.

For a flickering range during normal use, a range in which flicker is recognizable less varies. Meanwhile, a range in which flicker is annoying greatly varies in accordance with an individual difference, ambient brightness, and/or a BL luminance.

In view of the above, the grayscale range control section 110 is configured to change at least one of the upper-limit flickering grayscale level and the lower-limit flickering grayscale level in the flickering grayscale range in accordance with a result of sensing of the ambient illuminance.

With the configuration, proper setting of the upper-limit flickering grayscale level and/or the lower-limit flickering grayscale level in the flickering grayscale range by an experiment or the like can prevent a process that is carried out with respect to a flickering image from being carried out with respect to an image in which no flicker is recognized by (annoying to) a user. Thus, no unnecessary process needs to be carried out, so that still lower electric power consumption can be achieved.

According to the preceding embodiments, in a case where the image determining section 35 determines that an image is a flickering image, the control information output section 36 outputs the grayscale level control information so as to control the grayscale level control section 80 so that a grayscale level of the image is increased. This prevents recognizability of flicker due to an image that includes a large number of pixels having grayscale levels falling within the flickering grayscale range. Alternatively, recognizability of flicker may also be prevented by lowering the grayscale level as illustrated in FIG. 2. In a case where a surrounding area is dark, darkness of a screen is less annoying. Further, an increase in BL luminance can prevent each pixel from changing in front luminance before and after a change in grayscale level and BL luminance. For example, it is possible to carry out a process in which pixels having high grayscale levels falling within the flickering grayscale range are shifted to higher grayscale levels and pixels having low grayscale levels falling within the flickering grayscale range are shifted to lower grayscale levels.

According to the preceding embodiments, in a case where the image determining section 35 does not determine that an image is a flickering image, the control information output section 36 does not output the grayscale level and the luminance control information. Alternatively, the control information output section 36 may be configured to output information indicative of no change in grayscale level and luminance.

Embodiment 6

The following description will discuss a further embodiment of the present invention. For convenience, members similar in function to those described in the foregoing embodiment(s) will be given the same reference signs, and their description will be omitted. According to Embodiment 6, an image determining section and a display mode switching section are provided in a substrate other than a host control section. Further, according to Embodiment 6, in order that recognition of flicker is prevented, an image is displayed by a pseudo dot inversion technique in which image processing is used.

(Configuration of Display Device 5)

Figure 12:
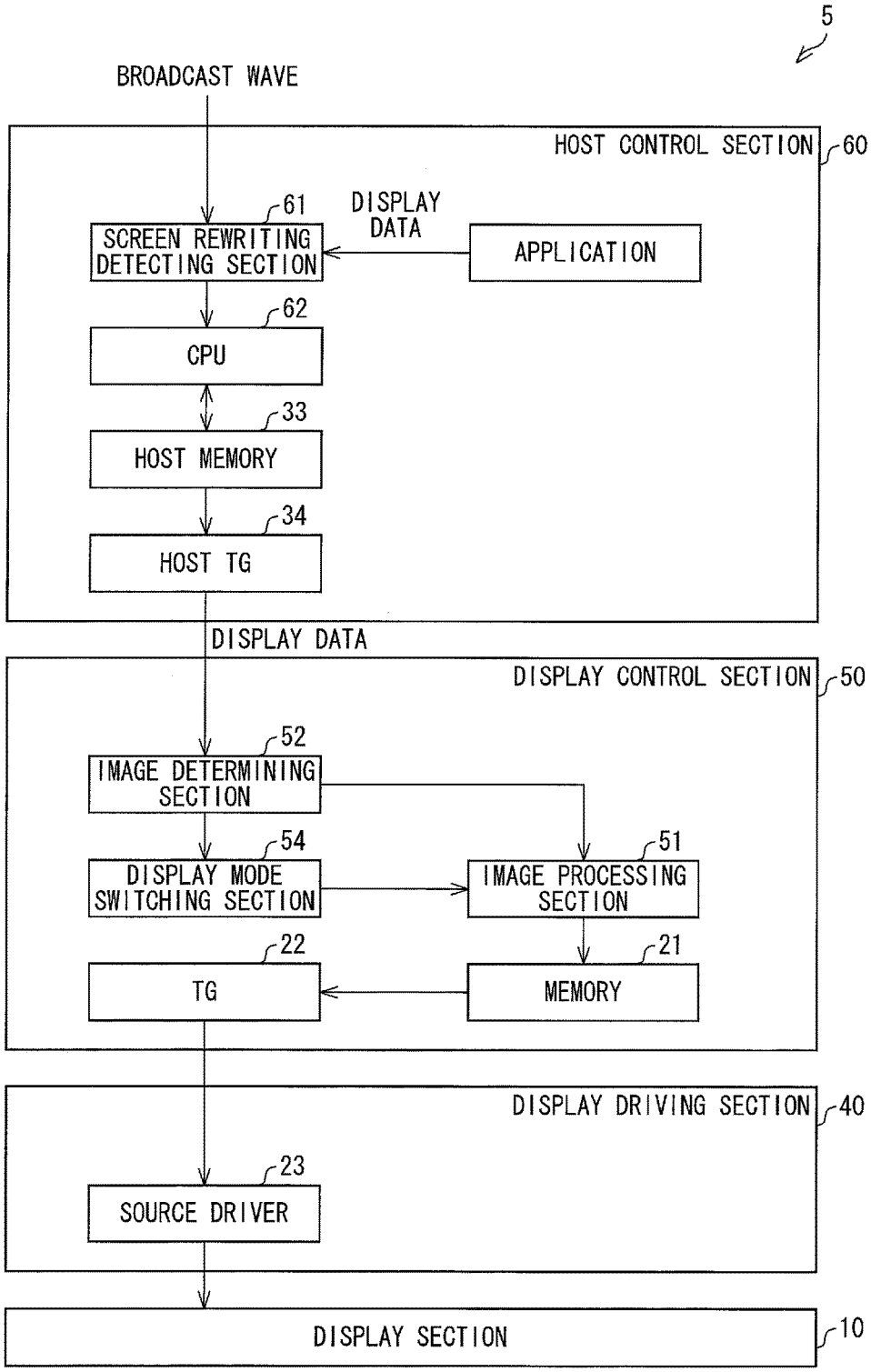
FIG. 12 is a block diagram illustrating a configuration of a display device in accordance with a further aspect of the present invention.

FIG. 12 is a block diagram illustrating a configuration of a display device in accordance with Embodiment 6. A display device 5 includes a display section 10, a display driving section 40, a display control section 50 (control device), and a host control section 60.

As with Embodiment 1, the display driving section 40 is a COG driver mounted on a glass substrate of the display section 10 by use of the COG technique, and drives the display section 10. The host control section 60 is a control substrate configured by a control circuit provided on a substrate, and is a main component for controlling a host side of the display device 5. The display control section 50 is a control substrate provided apart from the host control section 60 for processing a displayed image and the like. According to Embodiment 6, it is the display control section 50 that determines a display mode and carries out image processing in accordance with the display mode. This allows for a reduction in load of the host control section 60, and therefore makes it possible to secure performance of the host control section 60 for carrying out a process other than displaying an image.

The display driving section 40 includes a source driver 23.

(Configuration of Host Control Section 60)

The host control section 60 includes a screen rewriting detection section 61, a CPU 62, a host memory 33, and a host TG 34.

The screen rewriting detection section 61 may or may not evaluate an interval between points in time at which content of an image is changed and then notify the display control section 50 of the interval. For example, the evaluation of the interval can be carried out on a display-control-section-50 side. Any other process of the screen rewriting detection section 61 is carried out as is the case of the screen rewriting detection section 31 of Embodiment 1.

The CPU 62 carries out processes similar to those carried out by the CPU 32 of Embodiment 1 except that the CPU 62 does not supply display data to an image determining section.

Only in a case where a displayed image needs to be rewritten, the host TG 34 transfers display data on the image to the display control section 50.

(Configuration of Display Control Section 50)

The display control section 50 includes an image processing section 51 (grayscale level control section), an image determining section 52, a display mode switching section 54 (control information output section), a memory 21, and a TG 22.

The image determining section 52 which has received the display data from the host control section 60 determines whether or not an image based on the display data is an image which has a characteristic of causing flicker to be easily recognizable. The determining process of the image determining section 52 is similar to the process described in the preceding embodiments. The image determining section 52 then supplies a determined result to the display mode switching section 54. The image determining section 52 (rewriting detection section) can also (i) evaluate an interval between points in time at which content of the image is changed and (ii) supply data on the interval to the display mode switching section 54.

The display mode switching section 54 determines a display mode in accordance with a result of determination by the image determining section 52. In a case where the image determining section 52 determines that an image has no characteristic of causing flicker to be easily recognizable, the display mode switching section 54 determines that the image is to be displayed in a first display mode during a period in which the image is displayed. Meanwhile, in a case where the image determining section 52 determines that an image is a flickering image which has a characteristic of causing flicker to be easily recognizable, the display mode switching section 54 determines that the image is to be displayed in a second display mode during a period in which the image is displayed. According to Embodiment 6, the first display mode is a display mode in which no pseudo dot inversion process is carried out, and the second display mode is a display mode in which a pseudo dot inversion process is carried out. In order that image processing is carried out in accordance with the determined display mode, the display mode switching section 54 instructs the image processing section 51 on the display mode. That is, in a case where it is determined that an image is a flickering image, the display mode switching section 54 supplies, to the image processing section 51, grayscale level control information for carrying out control so as to change, by the pseudo dot inversion process, a pixel in which flicker is easily recognizable.

In accordance with the display mode, the image processing section 51 carries out the pseudo dot inversion process (image processing) with respect to the display data received from the host control section 60. In the first display mode, the image processing section 51 does not carry out the pseudo dot inversion process. Meanwhile, in the second display mode, the image processing section 51 carries out the pseudo dot inversion process.

The following description discusses the second display mode (pseudo dot inversion process). The image processing section 51 detects, for each of R, G, and B colors, a region which has a size equal to or larger than a predetermined size and in which grayscale levels of display data corresponding to a plurality of pixels are identical and fall within a predetermined first range (range of grayscale level 20 to grayscale level 80). A region in which pixels which have grayscale levels falling within the first range gather so as to have a size equal to or larger than a predetermined size is a region which causes flicker to be easily recognizable. The image processing section 51 carries out the image processing (pseudo dot inversion process) with respect to the display data so that the grayscale levels in the detected region (target region) are discontinuous in a row direction and/or a column direction so as to be checkered.

Figure 13:
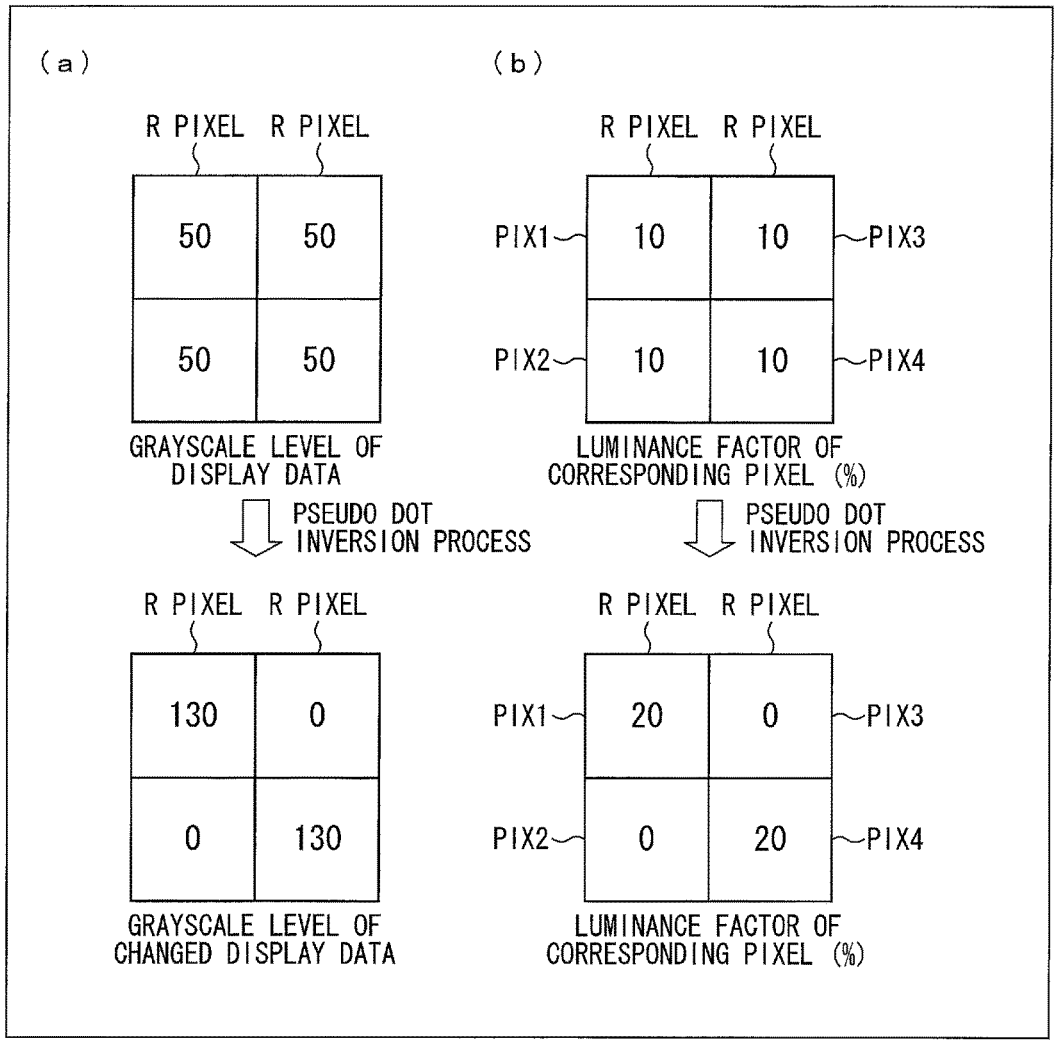
FIG. 13 is a set of views illustrating a change, caused by a pseudo dot inversion process, in grayscale level of display data and in luminance factor of a corresponding pixel, (a) of FIG. 13 illustrating the change, caused by the pseudo dot inversion process, in grayscale level of display data, and (b) of FIG. 13 illustrating the change in luminance factor of a corresponding pixel.

(a) of FIG. 13 illustrates a change, caused by the pseudo dot inversion process, in grayscale level of display data, and (b) of FIG. 13 illustrates a change in luminance factor of a corresponding pixel. FIG. 13 focuses on only R pixels. In display data, assume that R pixels in a target region have a grayscale level of 50. Unless the pseudo dot inversion process is carried out with respect to display data which has a grayscale level of 50, a corresponding pixel has a luminance factor (or transmittance) of 10%. The luminance factor is a percentage (%) of luminances assuming that a minimum luminance is 0% and a maximum luminance is 100%.

According to the pseudo dot inversion process, a process such as dithering or error diffusion is carried out with respect to a target region in display data, and image processing is carried out so that grayscale level values are discontinuously arranged in a row direction and a column direction so as to be checkered. Assume, for example, that the target region in the display data has a grayscale level of 50 falling within the first range (range of grayscale level 20 to grayscale level 80). In this case, for the target region, grayscale levels corresponding to respective pixels PIX1 and PIX4 are increased, and grayscale levels corresponding to respective pixels PIX2 and PIX3 each adjacent to the pixel PIX1 are lowered. That is, grayscale levels of a plurality of pixels in the display data which grayscale levels fall within the first range (range of grayscale level 20 to grayscale level 80) are changed to high grayscale levels (grayscale level 81 to grayscale level 255) and/or low grayscale levels (grayscale level 0 to grayscale level 19) each falling outside the first range. This allows a reduction in number of pixels which have grayscale levels falling within the first range and which cause flicker to be easily recognizable.

In a case where the pseudo dot inversion process is carried out, bright pixels having a luminance factor of 20% (the pixels PIX1 and PIX4) and dark pixels having a luminance factor of 0% (the pixels PIX2 and PIX3) are arranged in a checkered pattern. In this case, according to the display data which has been subjected to the pseudo dot inversion process (change in grayscale level), pixels having a grayscale level of 130 corresponding to a luminance factor of 20% and pixels having a grayscale level of 0 corresponding to a luminance factor of 0% are arranged in a checkered pattern. The target region which has been subjected to the pseudo dot inversion process has a luminance factor of 10% on average.

In a case where a change in grayscale level (image processing) is carried out as described earlier so that (i) an average of luminances of the pixel PIX1 and the pixel PIX2 which luminances are obtained in a case where the pseudo dot inversion process is carried out with respect to the display data (in the second display mode) and (ii) a luminance of the pixel PIX1 which luminance is obtained in a case where no pseudo dot inversion process is carried out with respect to the display data (in the first display mode) are equal to each other, it is possible to prevent a change in front luminance before and after change in grayscale level. Note, however, that the change in front luminance before and after change in grayscale level may be controlled to a level that is not strict but permissible.

Embodiment 6 discusses a case where the target region in the display data has a uniform grayscale level. Note, however, that, even in a case where the target region has a grayscale level that slightly varies, such as a gradation, it is only necessary to carry out a change in grayscale level so that (i) the target region which has not been subjected to the change and the target region which has been subjected to the change are equal in average luminance and (ii) grayscale levels (brightness and darkness) are distributed in a checkered pattern (dithering pattern).

(Effect of Display Device 5)

As described earlier, the image processing section 51 changes grayscale levels of a plurality of pixels in the display data which grayscale levels fall within the first range (range of grayscale level 20 to grayscale level 80) to high grayscale levels (grayscale level 81 to grayscale level 255) and/or low grayscale levels (grayscale level 0 to grayscale level 19) each falling outside the first range. This allows a reduction in number of pixels which have grayscale levels falling within the first range and which cause flicker to be easily recognizable. Further, a region to be subjected to a change in grayscale level has an average luminance that is unchanged before and after the change in grayscale level. Thus, it seems to a user as if an image displayed in the second display mode were identical to an image displayed in the first display mode. This allows the display device 5 to prevent recognition of flicker while maintaining display quality of an image.

Note that more electric power is consumed by carrying out image processing. According to Embodiment 6, the display device 5 carries out the pseudo dot inversion process only in a case where it is determined that an image causes flicker to be easily recognizable. This allows the display device 5 to prevent recognition of flicker while preventing an increase in electric power consumption.

Note that the image processing section 51, which carries out the pseudo dot inversion process and is described in Embodiment 6, the image determining section 52 described in Embodiment 6, and the display mode switching section 54 described in Embodiment 6 may be provided in the host control section.

According to the preceding embodiments, in a case where it is determined again, after grayscale levels are increased, whether or not an image is a flickering image and consequently it is determined that the image is a flickering image, it is possible to carry out a process for increasing the grayscale levels again.

According to the preceding embodiments, in a case where it is determined that an image is a flickering image, instead of processing grayscale levels of all pixels in each of which flicker is recognized, it is possible to partially process the grayscale levels sufficiently enough for flicker to be not recognizable. Such a case yields an effect of reducing a load of image processing by a reduction in number of pixels to be processed.

[Conclusion]

A control device in accordance with Aspect 1 of the present invention is a control device for a display device (1, 2, 3, 4, or 5), the control device including: an image determining section (35) for determining whether or not an image is a flickering image which has a characteristic of causing flicker to be easily recognizable; and a control information output section (36) for, in a case where the image determining section determines that the image is the flickering image, supplying, to a grayscale level control section (80) for carrying out control for changing a grayscale level of the flickering image, grayscale level control information for causing the grayscale level control section to carry out control for increasing or lowering a grayscale level of at least one pixel in which the flicker is easily recognizable.

A display device control method in accordance with Aspect 14 of the present invention is a method for controlling a display device, the method including the steps of: a) determining whether or not an image is a flickering image which has a characteristic of causing flicker to be easily recognizable; and b) in a case where it is determined in the step a) that the image is the flickering image, supplying, to a grayscale level control section for carrying out control for changing a grayscale level of the flickering image, grayscale level control information for causing the grayscale level control section to carry out control for increasing or lowering a grayscale level of a pixel in which the flicker is easily recognizable.

Flicker, whose recognizability greatly depends on a grayscale level, tends to be remarkably easily recognizable when the grayscale level is an intermediate grayscale level (recognizable on the lower grayscale level side especially at an intermediate grayscale level equal to or higher than grayscale level 10). In view of this, according to the configuration or the method, in a case where the image determining section determines that an image is a flickering image, the control information output section outputs the grayscale level control information so as to control the grayscale level control section so that a grayscale level of a pixel in which flicker is easily recognizable is increased or lowered. This prevents recognizability of flicker due to an image that includes a large number of pixels having grayscale levels falling within a flickering grayscale range.

In Aspect 2 of the present invention, the control device in accordance with Aspect 1 of the present invention may be configured such that, in a case where the image determining section determines that the image is the flickering image, the control information output section supplies, to the grayscale level control section for carrying out control for changing the grayscale level of the flickering image, the grayscale level control information for causing the grayscale level control section to carry out control for increasing or lowering a grayscale level of all or part of the image, the image including the at least one pixel in which the flicker is easily recognizable.

A flickering grayscale level is constant regardless of a luminance of a backlight. Note, however, that flicker tends to be hardly recognizable to human eyes in a case where a BL luminance is low.

In Aspect 3 of the present invention, the control device in accordance with Aspect 1 or 2 of the present invention may be configured such that: the control device is a control device for a display device including a backlight; and in a case where the image determining section determines that the image is the flickering image, the control information output section supplies, to a backlight control section for controlling a luminance of the backlight, luminance control information for causing the backlight control section to carry out control for lowering or increasing the luminance.

According to the configuration, in a case where the image determining section determines that an image is a flickering image, the control information output section outputs the luminance control information so as to control the backlight (hereinafter abbreviated as "BL") control section so that the luminance is lowered. This can prevent recognizability of flicker due to a high BL luminance.

Further, as described earlier, the grayscale level is increased and the BL luminance is lowered, so that each pixel is prevented from changing in front luminance before and after a change in grayscale level and BL luminance. Thus, a change in display quality can also be prevented.

Meanwhile, flicker, whose recognizability also greatly depends on a drive frequency, tends to be remarkably easily recognizable as a refresh rate is lowered. Thus, in a case where the control information is outputted, a display section is normally highly likely to be subjected to low refresh driving. The display section which is subjected to low refresh driving is driven at low electric power, and electric power consumed by the BL is more dominant than the electric power at which the display section is driven. In view of this, according to the configuration or the method, in a case where it is determined that an image is a flickering image (in this case, it is normally considered that the display section is subjected to low refresh driving), the BL luminance is lowered. This makes it possible to obtain not only an effect, yielded by low refresh driving, of reducing electric power consumption, but also an effect, yielded by lowering of the BL luminance, of reducing electric power consumption. Such a configuration as described above makes it possible to suppress electric power consumption as well as display an image with excellent quality.

Note that each pixel can be similarly prevented from changing in front luminance before and after a change in grayscale level and BL luminance also in a case where the grayscale level is lowered and the BL luminance is increased.

In Aspect 4 of the present invention, the control device in accordance with any one of Aspects 1 through 3 of the present invention may be configured such that by determining whether or not a percentage of pixels, of a plurality of pixels that are included in the at least one pixel in the image, which have grayscale levels falling within a flickering grayscale range is equal to or higher than a first threshold value, the flickering grayscale range being a range of flickering grayscale levels that are set in advance as grayscale levels which fall within a range of intermediate grayscale levels and at each of which the flicker easily occurs, the image determining section determines whether or not the image is the flickering image.

According to the configuration, a threshold value (the first threshold value) is set for the percentage of the pixels having grayscale levels within the flickering grayscale range (such pixels are hereinafter simply referred to as "flickering pixels"). Thus, proper setting of the first threshold value by an experiment or the like can prevent a process that is carried out with respect to a flickering image from being carried out with respect to an image in which no flicker is recognized by a user. Thus, no unnecessary process needs to be carried out, so that still lower electric power consumption can be achieved.

In Aspect 5 of the present invention, the control device in accordance with Aspect 4 of the present invention may further include a grayscale range control section for changing at least one of an upper-limit flickering grayscale level and a lower-limit flickering grayscale level in the flickering grayscale range in accordance with a result of sensing of an illuminance of an area around the display device.

An ambient illuminance and a flickering grayscale range have a correlation therebetween. In a case where a surrounding area is bright, flicker tends to be hardly recognizable. Thus, in a case where the ambient illuminance is higher, an upper-limit flickering grayscale level in the flickering grayscale range tends to shift to a lower level, and a lower-limit flickering grayscale level in the flickering grayscale range tends to shift to a higher level. In view of this, according to the configuration, the grayscale range control section changes at least one of the upper-limit flickering grayscale level and the lower-limit flickering grayscale level in the flickering grayscale range in accordance with a result of sensing of the ambient illuminance. With the configuration, proper setting of the upper-limit flickering grayscale level and/or the lower-limit flickering grayscale level in the flickering grayscale range by an experiment or the like can prevent a process that is carried out with respect to a flickering image from being carried out with respect to an image in which no flicker is recognized by a user. Thus, no unnecessary process needs to be carried out, so that still lower electric power consumption can be achieved.

In Aspect 6 of the present invention, the control device in accordance with any one of Aspects 1 through 5 may be configured such that in order to cause the display device to display the image at a refresh rate that is equal to or lower than a predetermined refresh rate, the image determining section determines whether or not the image is the flickering image.

According to the configuration, in a case where the predetermined refresh rate serving as a threshold against which to determine whether or not flicker is easily recognizable is properly set by an experiment or the like, determination of whether an image is a flickering image does not need to be unnecessarily carried out with respect to a case where the display section is driven at a refresh rate at which a user recognizes no flicker. This makes it possible to further reduce electric power consumption.

In Aspect 7 of the present invention, the control device in accordance with Aspect 3 of the present invention may be configured such that the grayscale level control information and the luminance control information each contain (i) information on a degree of change in grayscale level which change occurs when control for increasing the grayscale level of the flickering image is carried out, the degree being set so as not to change respective front luminances of a plurality of pixels that are included in the image, the image being displayed on the display device, and (ii) information on a degree of change in luminance which change occurs when control for lowering the luminance of the backlight is carried out.

According to the configuration, since a front luminance of each pixel is not changed, it is possible to display an image with more excellent quality.

In Aspect 8 of the present invention, the control device in accordance with each of Aspects 3 and 4 may be configured such that: the control information output section does not output the grayscale level control information and/or the luminance control information in a case where the percentage of the pixels having grayscale levels within the flickering grayscale range is lower than the first threshold value; and the control information output section outputs the grayscale level control information and/or the luminance control information in a case where the percentage of the pixels having grayscale levels within the flickering grayscale range is equal to or higher than the first threshold value.

According to the configuration, proper setting of the first threshold value by an experiment or the like can prevent a process that is carried out with respect to a flickering image from being carried out with respect to an image in which no flicker is recognized by a user. Thus, no unnecessary process needs to be carried out, so that still lower electric power consumption can be achieved.

In Aspect 9 of the present invention, the control device in accordance with each of Aspects 3 and 4 may further include: a rewriting detection section for evaluating an interval between points in time where content of the image is changed, the control information output section not outputting the grayscale level control information and/or the luminance control information in a case where the interval is equal to or shorter than a predetermined interval threshold value, or in a case where the interval is longer than the interval threshold value and the percentage of the pixels having grayscale levels within the flickering grayscale range is lower than the first threshold value, and the control information output section outputting the grayscale level control information and/or the luminance control information in a case where the interval is longer than the interval threshold value and the percentage of the pixels having grayscale levels within the flickering grayscale range is equal to or higher than the first threshold value.

According to the configuration, proper setting of the interval threshold value by an experiment or the like can prevent a process that is carried out with respect to a flickering image from being carried out with respect to an image which is displayed at an interval between points in time where no flicker is recognized by a user. Thus, no unnecessary process needs to be carried out, so that still lower electric power consumption can be achieved.

In Aspect 10 of the present invention, the control device in accordance with Aspect 4 of the present invention may be configured such that: a single picture element includes a plurality of pixels of different colors; and the image determining section (i) determines, for each of the different colors, a percentage of pixels, of all pixels that are included in the at least one pixel in the image, which have grayscale levels falling within the flickering grayscale range, (ii) determines weighted values of the respective percentages, (iii) determines a sum of the weighted values, and (iv) determines whether or not the sum is equal to or higher than a second threshold value.

Human visual sensitivity generally varies depending on a hue. Thus, in a case where a pixel having a hue that is high in visual sensitivity is heavily weighted and a pixel having a hue that is low in visual sensitivity is less heavily weighted, an image can be determined in accordance with human visual sensitivity. With this, since no unnecessary process needs to be carried out with respect to a case where no flicker is recognized depending on human visual sensitivity, still lower electric power consumption can be achieved.

In Aspect 11 of the present invention, the control device in accordance with Aspect 4 of the present invention may be configured such that: a single picture element includes a plurality of pixels of different colors; and the image determining section determines a luminance of the picture element from grayscale levels of the plurality of pixels included in the picture element, and, in a case where the luminance of the picture element falls within a predetermined luminance range, determines that the grayscale levels of the plurality of pixels included in the picture element fall within the flickering grayscale range.

According to the configuration, for example, the image determining section which includes a storage section only needs to store information on luminances of respective picture elements. Thus, in this case, a storage capacity only needs to be approximately ⅓ of a storage capacity required in a case where the image determining section stores information indicative of grayscale levels of the respective pixels.

In Aspect 12 of the present invention, the control device in accordance with Aspect 4 of the present invention may be configured such that: by determining whether or not the image includes a predetermined pattern made up of the pixels which have grayscale levels falling within the flickering grayscale range, the image determining section determines whether or not the image is the flickering image.

In a case where a region is locally present in which pixels having flickering grayscale levels are closely distributed, then flicker is easily recognizable even if a small percentage of pixels of the entire pixels have flickering grayscale levels. In other words, if pixels having flickering grayscale levels are concentrated in an area that is equal to or larger than a certain region, then flicker is more easily recognizable. In a case where pattern matching is carried out by patterning such a locally present aggregate of pixels having flickering grayscale levels, it can be determined that an image in which a percentage of flickering pixels is small but flicker is recognized due to presence of a locally present aggregate of pixels having flickering grayscale levels is also a flickering image.

A display device in accordance with Aspect 13 of the present invention includes: a control device in accordance with any one of Aspects 1 through 12; and a grayscale level control section for, in response to the grayscale level control information, carrying out control for changing a grayscale level of the flickering image. The display device may further include a backlight control section for, in response to the luminance control information, carrying out control for increasing or lowering a luminance of the backlight.

The configuration in which control is carried out so that a grayscale level of a pixel is increased and a luminance of a backlight is lowered makes it possible to suppress electric power consumption as well as display an image with excellent quality.

[Additional Remarks]

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention can be used in a display device and a control device of the display device. The present invention is suitable for, for example, a liquid crystal display device, a host control section of the liquid crystal display device, a liquid crystal driver of the liquid crystal display device, and a liquid crystal driver controller (LCDC) of the liquid crystal display device.

REFERENCE SIGNS LIST

| | |
|---|---|
| 1, 2, 3, 4, 5 | Display device |
| 10 | Display section |
| 11a-11d | Screen |
| 13, 13a-13h | Analysis region |
| 15 | Pattern |
| 16a, 16b | Grayscale map |
| 20, 40, 70 | Display driving section (control device) |
| 30, 60 | Host control section (control device) |
| 31, 61 | Screen rewriting detection section |
| 35, 52 | Image determining section |
| 36, 53 | Control information output section |
| 50 | Display control section (control device) |
| 51 | Image processing section (grayscale level control section) |
| 54 | Display mode switching section (control information output section) |
| 80 | Grayscale level control section |
| 90 | Backlight control section |

The invention claimed is:

1. A control device for a display device, said control device comprising:

image determining circuitry that determines whether or not a percentage of pixels having grayscale levels within a first grayscale level range out of a plurality of pixels in one frame of image data is equal to or higher than a first threshold value, the first grayscale level range being a predetermined grayscale level range within a range of intermediate grayscale levels, the image data being data to be supplied to the display device and indicative of grayscale levels of respective pixels for each frame; and control information output circuitry that, in accordance with a result of a determination made by the image determining circuitry, supplies, to grayscale level control circuitry that controls changing a grayscale level in the image data, grayscale level control information that causes the grayscale level control circuitry to control changing the grayscale level in the image data.

2. The control device as set forth in claim 1, wherein, in a case where the image determining circuitry determines that the image data is image data in which the percentage of the pixels having the grayscale levels within the first grayscale level range is equal to or higher than the first threshold value, the control information output circuitry supplies, to the grayscale level control circuitry that controls changing the grayscale level in the image data, the grayscale level control information that causes the grayscale level control circuitry to control increasing or lowering a grayscale level of all or part of the image data, the image data including at least one pixel in which flicker is easily recognizable.

3. The control device as set forth in claim 1, wherein in order to cause the display device to display the image data at a refresh rate that is equal to or lower than a predetermined refresh rate, the image determining circuitry determines whether or not the image data is image data in which the percentage of pixels having grayscale levels within the first grayscale level range out of the plurality of pixels in the one frame of image data is equal to or higher than the first threshold value.

4. A control device for a display device, said control device comprising:

image determining circuitry that determines whether or not an image is a flickering image which has a characteristic of causing flicker to be easily recognizable; and control information output circuitry that, in a case where the image determining circuitry determines that the image is the flickering image, supplies, to grayscale level control circuitry that controls changing a grayscale level of the flickering image, grayscale level control information that causes the grayscale level control circuitry to control increasing or lowering a grayscale level of at least one pixel in which the flicker is easily recognizable, wherein:

in the case where the image determining circuitry determines that the image is the flickering image, the control information output circuitry supplies, to backlight control circuitry that controls a luminance of a backlight of the display device, luminance control information that causes the backlight control circuitry to control the luminance to be lower than a predetermined value.

5. The control device as set forth in claim 4, wherein the grayscale level control information and the luminance control information each contain (i) information on a degree of change in grayscale level which change occurs when control for increasing the grayscale level of the flickering image is carried out, the degree being set so as not to change respective front luminances of a plurality of pixels that are included in the image, the image being displayed on the display device, and (ii) information on a degree of change in luminance which change occurs when control for lowering the luminance of the backlight is carried out.

6. The control device as set forth in claim 4, wherein:

by determining whether or not a percentage of pixels of a plurality of pixels that are included in the at least one pixel in the image which have grayscale levels falling within a flickering grayscale range is equal to or higher than a first threshold value, the flickering grayscale range being a range of flickering grayscale levels that are set in advance as grayscale levels which fall within a range of intermediate grayscale levels and at each of which the flicker easily occurs, the image determining circuitry determines whether or not the image is the flickering image;

the control information output circuitry does not output the grayscale level control information and/or the luminance control information in a case where the percentage of the pixels having grayscale levels within the flickering grayscale range is lower than the first threshold value; and the control information output circuitry outputs the grayscale level control information and/or the luminance control information in a case where the percentage of the pixels having grayscale levels within the flickering grayscale range is equal to or higher than the first threshold value.

7. The control device as set forth in claim 4, further comprising:

rewriting detection circuitry that evaluates an interval between points in time where content of the image is changed, wherein by determining whether or not a percentage of pixels of a plurality of pixels that are included in the at least one pixel in the image which have grayscale levels falling within a flickering grayscale range is equal to or higher than a first threshold value, the flickering grayscale range being a range of flickering grayscale levels that are set in advance as grayscale levels which fall within a range of intermediate grayscale levels and at each of which the flicker easily occurs, the image determining circuitry determines whether or not the image is the flickering image, the control information output circuitry does not output the grayscale level control information and/or the luminance control information in a case where the interval is equal to or shorter than a predetermined interval threshold value, or in a case where the interval is longer than the interval threshold value and the percentage of the pixels having grayscale levels within the flickering grayscale range is lower than the first threshold value, and the control information output circuitry outputs the grayscale level control information and/or the luminance control information in a case where the interval is longer than the interval threshold value and the percentage of the pixels having grayscale levels within the flickering grayscale range is equal to or higher than the first threshold value.

8. A control device for a display device, said control device comprising:

image determining circuitry that determines whether or not an image is a flickering image which has a characteristic of causing flicker to be easily recognizable; and control information output circuitry that, in a case where the image determining circuitry determines that the image is the flickering image, supplies, to grayscale level control circuitry that controls changing a grayscale level of the flickering image, grayscale level control information that causes the grayscale level control circuitry to control increasing or lowering a grayscale level of at least one pixel in which the flicker is easily recognizable, wherein by determining whether or not a percentage of pixels, of a plurality of pixels that are included in the at least one pixel in the image, which have grayscale levels falling within a flickering grayscale range is equal to or higher than a first threshold value, the flickering grayscale range being a range of flickering grayscale levels that are set in advance as grayscale levels which fall within a range of intermediate grayscale levels and at each of which the flicker easily occurs, the image determining circuitry determines whether or not the image is the flickering image.

9. The control device as set forth in claim 8, further comprising grayscale range control circuitry that, in a case where an illuminance of an area around the display device has been sensed is higher than another illuminance that has not been sensed, lowers an upper-limit flickering grayscale level in the flickering grayscale range and increases a lower-limit flickering grayscale level in the flickering grayscale range.

10. The control device as set forth in claim 8, wherein:

a single picture element includes a plurality of pixels of different colors; and the image determining circuitry (i) determines, for each of the different colors, a percentage of pixels, of all pixels that are included in the at least one pixel in the image which have grayscale levels falling within the flickering grayscale range, (ii) determines weighted values of the respective percentages, (iii) determines a sum of the weighted values, and (iv) determines whether or not the sum of the weighted values is equal to or higher than a second threshold value.

11. The control device as set forth in claim 8, wherein:

a single picture element includes a plurality of pixels of different colors; and the image determining circuitry determines a luminance of the picture element from grayscale levels of the plurality of pixels included in the picture element, and, in a case where the luminance of the picture element falls within a predetermined luminance range, determines that the grayscale levels of the plurality of pixels included in the picture element fall within the flickering grayscale range.

12. The control device as set forth in claim 8, wherein:

by determining whether or not the image includes a predetermined pattern made up of the pixels which have grayscale levels falling within the flickering grayscale range, the image determining circuitry determines whether or not the image is the flickering image.

13. A display device comprising:

grayscale level control circuitry; and a control device including:

image determining circuitry that determines whether or not a percentage of pixels having grayscale levels within a first grayscale level range out of a plurality of pixels in one frame of image data is equal to or higher than a first threshold value, the first grayscale level range being a predetermined grayscale level range within a range of intermediate grayscale levels, the image data being data to be supplied to the display device and indicative of grayscale levels of respective pixels for each frame; and control information output circuitry that, in accordance with a result of a determination made by the image determining circuitry, supplies, to the grayscale level control circuitry, grayscale level control information that causes the grayscale level control circuitry to control changing the grayscale level in the image data, the grayscale level control circuitry controls changing the grayscale level in the image data in response to the grayscale level control information.

14. A method for controlling a display device, said method comprising steps of:

a) determining whether or not a percentage of pixels having grayscale levels within a first grayscale level range out of a plurality of pixels in one frame of image data is equal to or higher than a first threshold value, the first grayscale level range being a predetermined grayscale level range within a range of intermediate grayscale levels, the image data being data to be supplied to the display device and indicative of grayscale levels of respective pixels for each frame; and b) in accordance with a result of a determination in the step a), supplying, to grayscale level control circuitry that controls changing a grayscale level in the image data, grayscale level control information that causes the grayscale level control circuitry to control changing the grayscale level in the image data.

* * * * *